US009617686B2

(12) United States Patent
Nonni et al.

(10) Patent No.: US 9,617,686 B2
(45) Date of Patent: Apr. 11, 2017

(54) USE OF SURFACTANT TO TREAT PULP AND IMPROVE THE INCORPORATION OF KRAFT PULP INTO FIBER FOR THE PRODUCTION OF VISCOSE AND OTHER SECONDARY FIBER PRODUCTS

(71) Applicant: GP CELLULOSE GMBH, Zug (CH)

(72) Inventors: Arthur James Nonni, Peachtree City, GA (US); Charles Edward Courchene, Snellville, GA (US); Christopher Michael Slone, Atlanta, GA (US); Philip Reed Campbell, Gulf Shore, AL (US); Steven Chad Dowdle, Pace, FL (US); Joel Mark Engle, Purvis, MS (US)

(73) Assignee: GP Cellulose GmbH, Zug (CH)

( * ) Notice: Subject to any disclaimer, the term of this patent is extended or adjusted under 35 U.S.C. 154(b) by 0 days.

(21) Appl. No.: 14/395,027

(22) PCT Filed: Apr. 5, 2013

(86) PCT No.: PCT/US2013/035494
§ 371 (c)(1),
(2) Date: Oct. 16, 2014

(87) PCT Pub. No.: WO2013/158384
PCT Pub. Date: Oct. 24, 2013

(65) Prior Publication Data

US 2015/0126728 A1 May 7, 2015

Related U.S. Application Data

(60) Provisional application No. 61/635,185, filed on Apr. 18, 2012.

(51) Int. Cl.

| | |
|---|---|
| ***D21H 21/32*** | (2006.01) |
| ***D21H 11/04*** | (2006.01) |
| ***D21C 3/26*** | (2006.01) |
| ***D21C 9/10*** | (2006.01) |
| ***D21C 9/153*** | (2006.01) |
| ***D21H 11/16*** | (2006.01) |
| ***D21H 17/00*** | (2006.01) |

(52) U.S. Cl.
CPC ..... *D21H 21/32* (2013.01); *D21C 3/263* (2013.01); *D21C 9/1057* (2013.01); *D21C 9/153* (2013.01); *D21H 11/04* (2013.01); *D21H 11/16* (2013.01); *D21H 17/74* (2013.01)

(58) Field of Classification Search
CPC ..... D21H 21/32; D21H 11/04; D21C 3/263; D21C 9/1057
USPC ..... 536/56; 162/157.6
See application file for complete search history.

(56) References Cited

U.S. PATENT DOCUMENTS

| | | | | |
|---|---|---|---|---|
| 1,860,431 | A | 5/1932 | Richter | |
| 2,112,116 | A | 3/1938 | Richter | |
| 2,368,527 | A | 1/1945 | Edelstein | |
| 2,749,336 | A | 6/1956 | Boddicker et al. | |
| 2,978,446 | A | 4/1961 | Battista et al. | |
| 3,728,331 | A | 4/1973 | Savage | |
| 3,868,955 | A | 3/1975 | Steiger et al. | |
| 4,410,397 | A | 10/1983 | Kempf | |
| 4,661,205 | A | 4/1987 | Ow et al. | |
| H000479 | H | 6/1988 | Wood et al. | |
| 5,223,170 | A * | 6/1993 | Ohashi | C08G 77/26 252/8.63 |
| 5,302,248 | A | 4/1994 | Weinstock et al. | |
| 5,346,589 | A | 9/1994 | Braunstein et al. | |
| 5,447,602 | A | 9/1995 | Sajbel et al. | |
| 5,522,967 | A | 6/1996 | Shet | |
| 5,552,019 | A | 9/1996 | Weinstock et al. | |
| 5,562,645 | A | 10/1996 | Tanzer et al. | |
| 5,580,485 | A | 12/1996 | Feringa et al. | |
| 5,593,543 | A | 1/1997 | Balos et al. | |
| 5,630,906 | A | 5/1997 | Boe et al. | |
| 5,639,348 | A | 6/1997 | Payton et al. | |
| 5,703,225 | A | 12/1997 | Shet et al. | |
| 5,853,428 | A | 12/1998 | Collins et al. | |
| 5,876,625 | A | 3/1999 | Collins et al. | |
| 5,994,531 | A | 11/1999 | Doenges et al. | |
| 6,010,594 | A | 1/2000 | Henricson et al. | |
| 6,099,586 | A | 8/2000 | Collins et al. | |
| 6,100,441 | A | 8/2000 | Blomstrom et al. | |
| 6,136,223 | A | 10/2000 | Collins et al. | |
| 6,146,494 | A | 11/2000 | Seger et al. | |
| 6,210,801 | B1 | 4/2001 | Luo et al. | |

(Continued)

FOREIGN PATENT DOCUMENTS

| | | |
|---|---|---|
| AU | 626407 | 7/1992 |
| CA | 1129161 | 8/1982 |
| DE | 19620241 | 11/1997 |
| EP | 0172135 | 2/1986 |
| EP | 0647158 | 8/1997 |
| EP | 0845966 | 3/2000 |
| EP | 0999222 | 5/2000 |
| EP | 1077282 | 2/2001 |
| EP | 1077285 | 2/2001 |
| EP | 1106732 | 6/2001 |

(Continued)

OTHER PUBLICATIONS

International Search Report and Written Opinion issued Jul. 27, 2013 in corresponding Application No. PCT/U52013/035987.

(Continued)

*Primary Examiner* — Sudhakar Katakam
*Assistant Examiner* — Everett White
(74) *Attorney, Agent, or Firm* — Ram W. Sabnis

(57) ABSTRACT

A surfactant treated bleached softwood kraft pulp fiber, useful as a starting material In the production of cellulose derivatives including cellulose ether, cellulose esters and viscose, is disclosed. Methods for making the kraft pulp fiber and products made from it are also described.

47 Claims, 4 Drawing Sheets

(56) References Cited

U.S. PATENT DOCUMENTS

| | | | |
|---|---|---|---|
| 6,214,976 | B1 | 4/2001 | Watanabe et al. |
| 6,221,209 | B1 | 4/2001 | Desprez et al. |
| 6,221,487 | B1 | 4/2001 | Luo et al. |
| 6,228,126 | B1 | 5/2001 | Cimecioglu et al. |
| 6,235,392 | B1 | 5/2001 | Luo et al. |
| 6,241,779 | B1 | 6/2001 | Collins et al. |
| 6,306,334 | B1 | 10/2001 | Luo et al. |
| 6,319,361 | B1 | 11/2001 | Smith et al. |
| 6,331,354 | B1 | 12/2001 | Sealey, II et al. |
| 6,368,456 | B1 | 4/2002 | Cimecioglu et al. |
| 6,379,494 | B1 | 4/2002 | Jewell et al. |
| 6,398,908 | B1 | 6/2002 | Hermansson et al. |
| 6,432,266 | B1 | 8/2002 | Fukushima et al. |
| 6,440,523 | B1 | 8/2002 | Sealey, II et al. |
| 6,440,547 | B1 | 8/2002 | Luo et al. |
| 6,444,314 | B1 | 9/2002 | Luo et al. |
| 6,471,727 | B2 | 10/2002 | Luo et al. |
| 6,491,788 | B2 | 12/2002 | Sealey, II et al. |
| 6,511,930 | B1 | 1/2003 | Luo et al. |
| 6,514,613 | B2 | 2/2003 | Luo et al. |
| 6,515,049 | B1 | 2/2003 | Doenges et al. |
| 6,518,419 | B1 | 2/2003 | Van Der Lugt et al. |
| 6,524,348 | B1 | 2/2003 | Jewell et al. |
| 6,528,163 | B2 | 3/2003 | Sealey, II et al. |
| 6,540,876 | B1 | 4/2003 | Cimecioglu et al. |
| 6,541,627 | B1 | 4/2003 | Ono et al. |
| 6,562,195 | B2 | 5/2003 | Cimecioglu et al. |
| 6,582,559 | B2 | 6/2003 | Thornton et al. |
| 6,586,588 | B1 | 7/2003 | Cimecioglu et al. |
| 6,596,033 | B1 | 7/2003 | Luo et al. |
| 6,605,181 | B1 | 8/2003 | Bergqvist et al. |
| 6,605,350 | B1 | 8/2003 | Sealey, II et al. |
| 6,627,749 | B1 | 9/2003 | Kumar |
| 6,635,755 | B1 | 10/2003 | Jaschinski et al. |
| 6,685,856 | B2 | 2/2004 | Sealey, II et al. |
| 6,686,039 | B2 | 2/2004 | Sealey, II et al. |
| 6,686,040 | B2 | 2/2004 | Sealey, II et al. |
| 6,686,464 | B1 | 2/2004 | Harding et al. |
| 6,692,827 | B2 | 2/2004 | Luo et al. |
| 6,695,950 | B1 | 2/2004 | Cimecioglu et al. |
| 6,706,237 | B2 | 3/2004 | Luo et al. |
| 6,706,876 | B2 | 3/2004 | Luo et al. |
| 6,716,976 | B1 | 4/2004 | Jetten et al. |
| 6,765,042 | B1 | 7/2004 | Thornton et al. |
| 6,770,755 | B1 | 8/2004 | Gunnars et al. |
| 6,773,648 | B2 | 8/2004 | Luo et al. |
| 6,797,113 | B2 | 9/2004 | Sealey, II et al. |
| 6,821,383 | B2 | 11/2004 | Shore et al. |
| 6,824,645 | B2 | 11/2004 | Jaschinski et al. |
| 6,849,156 | B2 | 2/2005 | Besemer et al. |
| 6,861,023 | B2 | 3/2005 | Sealey, II et al. |
| 6,872,821 | B2 | 3/2005 | Cimecioglu et al. |
| 6,896,725 | B2 | 5/2005 | Thornton et al. |
| 6,916,466 | B2 | 7/2005 | Besemer et al. |
| 6,924,369 | B2 | 8/2005 | Doenges et al. |
| 6,936,710 | B2 | 8/2005 | Bragd et al. |
| 6,958,108 | B1 | 10/2005 | Vuorinen |
| 6,987,181 | B2 | 1/2006 | Jaschinski et al. |
| 7,001,483 | B2 | 2/2006 | Severeid et al. |
| 7,019,191 | B2 | 3/2006 | Looney et al. |
| 7,022,837 | B2 | 4/2006 | Harding et al. |
| 7,067,444 | B2 | 6/2006 | Luo et al. |
| 7,083,704 | B2 | 8/2006 | Sealey, II et al. |
| 7,090,744 | B2 | 8/2006 | Sealey, II et al. |
| 7,161,005 | B2 | 1/2007 | Schlingloff et al. |
| 7,247,722 | B2 | 7/2007 | Cimecioglu et al. |
| 7,252,837 | B2 | 8/2007 | Guo et al. |
| 7,279,177 | B2 | 10/2007 | Looney et al. |
| 7,326,317 | B2 | 2/2008 | Westermark et al. |
| 7,390,566 | B2 | 6/2008 | Luo et al. |
| 7,411,110 | B2 | 8/2008 | Sawyer et al. |
| 7,455,902 | B2 | 11/2008 | Weerawarna et al. |
| 7,456,285 | B2 | 11/2008 | Schlingloff et al. |
| 7,520,958 | B2 | 4/2009 | Tan et al. |
| 7,541,396 | B2 | 6/2009 | Luo et al. |
| 7,608,167 | B2 | 10/2009 | Luo et al. |
| 7,692,004 | B2 | 4/2010 | Schlingloff et al. |
| 7,700,764 | B2 | 4/2010 | Heijnesson-Hulten |
| 7,708,214 | B2 | 5/2010 | Medoff |
| 7,727,945 | B2 | 6/2010 | Rodrigues et al. |
| 7,867,358 | B2 | 1/2011 | Medoff |
| 7,867,359 | B2 | 1/2011 | Medoff |
| 7,939,101 | B2 | 5/2011 | Obae et al. |
| 7,947,292 | B2 | 5/2011 | Besemer et al. |
| 7,955,536 | B2 | 6/2011 | Sawyer et al. |
| 7,971,809 | B2 | 7/2011 | Medoff |
| 7,976,676 | B2 | 7/2011 | Yin et al. |
| 8,007,635 | B2 | 8/2011 | Tan et al. |
| 8,029,896 | B2 | 10/2011 | Kumamoto et al. |
| 8,044,013 | B2 | 10/2011 | Schlingloff et al. |
| 8,057,636 | B2 | 11/2011 | Vinson et al. |
| 8,084,391 | B2 | 12/2011 | Weerawarna |
| 8,372,765 | B2 | 2/2013 | Braig et al. |
| 9,121,134 | B2 | 9/2015 | Wernersson et al. |
| 2001/0025695 | A1 | 10/2001 | Patt et al. |
| 2001/0050153 | A1 | 12/2001 | Wajer et al. |
| 2005/0061455 | A1 | 3/2005 | Tan et al. |
| 2006/0070711 | A1 | 4/2006 | Luo |
| 2006/0159733 | A1 | 7/2006 | Pendharkar et al. |
| 2006/0260773 | A1 | 11/2006 | Tan et al. |
| 2007/0000627 | A1 | 1/2007 | Tan et al. |
| 2007/0119556 | A1 | 5/2007 | Tan et al. |
| 2007/0125507 | A1 | 6/2007 | Walter et al. |
| 2007/0199668 | A1 | 8/2007 | Scarpello et al. |
| 2007/0272377 | A1 | 11/2007 | Mei et al. |
| 2008/0188636 | A1 | 8/2008 | Argyropoulos et al. |
| 2008/0308239 | A1 | 12/2008 | Hart et al. |
| 2009/0044345 | A1 | 2/2009 | Schlingloff et al. |
| 2009/0054863 | A1 | 2/2009 | Tan et al. |
| 2009/0165968 | A1 | 7/2009 | Tan et al. |
| 2009/0312537 | A1 | 12/2009 | Medoff |
| 2010/0055437 | A1 | 3/2010 | Fink et al. |
| 2010/0124583 | A1 | 5/2010 | Medoff |
| 2010/0206501 | A1 | 8/2010 | Medoff |
| 2010/0233481 | A1 | 9/2010 | Isogai et al. |
| 2010/0282422 | A1 | 11/2010 | Miyawaki et al. |
| 2010/0316863 | A1 | 12/2010 | Kumamoto et al. |
| 2010/0320156 | A1 | 12/2010 | Olaiya et al. |
| 2011/0139383 | A1 | 6/2011 | Medoff |
| 2011/0287275 | A1 | 11/2011 | Tan et al. |
| 2012/0004194 | A1 | 1/2012 | Lu et al. |

FOREIGN PATENT DOCUMENTS

| | | | | |
|---|---|---|---|---|
| EP | 1154074 | | 11/2001 | |
| EP | 1156065 | | 11/2001 | |
| EP | 1093467 | | 3/2002 | |
| EP | 0889997 | | 7/2002 | |
| EP | 0923635 | | 2/2003 | |
| EP | 1300420 | | 4/2003 | |
| EP | 0787231 | | 5/2003 | |
| EP | 1228099 | | 9/2003 | |
| EP | 1025305 | | 11/2003 | |
| EP | 1068376 | | 11/2003 | |
| EP | 0511695 | | 6/2004 | |
| EP | 1430911 | | 6/2004 | |
| EP | 1155039 | | 7/2004 | |
| EP | 1469125 | A1 * | 10/2004 | ..... D21H 17/71 |
| EP | 0863158 | | 11/2004 | |
| EP | 1077286 | | 2/2005 | |
| EP | 1541590 | | 6/2005 | |
| EP | 1278913 | | 11/2005 | |
| EP | 1155040 | | 4/2006 | |
| EP | 1383857 | | 5/2006 | |
| EP | 1245722 | | 6/2006 | |
| EP | 1230456 | | 7/2006 | |
| EP | 1676863 | | 7/2006 | |
| EP | 1311717 | | 8/2006 | |
| EP | 1137672 | | 12/2006 | |
| EP | 1743906 | | 1/2007 | |
| EP | 1668180 | | 8/2007 | |
| EP | 1862587 | | 12/2007 | |
| EP | 2084325 | | 4/2010 | |
| EP | 2216345 | | 8/2010 | |

(56) References Cited

FOREIGN PATENT DOCUMENTS

| | | | | |
|---|---|---|---|---|
| EP | 2226414 | | 9/2010 | |
| EP | 2236665 | | 10/2010 | |
| EP | 1694711 | | 12/2010 | |
| JP | 2001181961 | A * | 7/2001 | ..... D06M 11/00 |
| JP | 2003/096681 | | 4/2003 | |
| WO | WO 92/14760 | | 9/1992 | |
| WO | WO 94/20673 | | 9/1994 | |
| WO | WO 94/21690 | | 9/1994 | |
| WO | WO 95/06157 | | 3/1995 | |
| WO | WO 95/26438 | | 10/1995 | |
| WO | WO 95/34628 | | 12/1995 | |
| WO | WO 95/35406 | | 12/1995 | |
| WO | WO 96/09434 | | 3/1996 | |
| WO | WO 96/20667 | | 7/1996 | |
| WO | WO 96/38111 | | 12/1996 | |
| WO | WO 98/03626 | | 1/1998 | |
| WO | WO 98/56981 | | 12/1998 | |
| WO | WO 99/09244 | | 2/1999 | |
| WO | WO 99/47733 | | 9/1999 | |
| WO | WO 99/57158 | | 11/1999 | |
| WO | WO 99/57370 | | 11/1999 | |
| WO | WO 00/26257 | | 5/2000 | |
| WO | WO 00/50462 | | 8/2000 | |
| WO | WO 00/50463 | | 8/2000 | |
| WO | WO 00/65145 | | 11/2000 | |
| WO | WO 01/29309 | | 4/2001 | |
| WO | WO 01/34656 | | 5/2001 | |
| WO | WO 01/34657 | | 5/2001 | |
| WO | WO 01/83887 | | 11/2001 | |
| WO | WO 01/88236 | | 11/2001 | |
| WO | WO 02/48196 | | 6/2002 | |
| WO | WO 02/48197 | | 6/2002 | |
| WO | WO 02/49565 | | 6/2002 | |
| WO | WO 02/086206 | | 10/2002 | |
| WO | WO 02/088289 | | 11/2002 | |
| WO | WO 03/006739 | | 1/2003 | |
| WO | WO 03/042451 | | 5/2003 | |
| WO | WO 2004/062703 | | 7/2004 | |
| WO | WO 2005/028744 | | 3/2005 | |
| WO | WO 2005/058972 | | 6/2005 | |
| WO | WO 2005/068074 | | 7/2005 | |
| WO | WO 2006/102543 | | 9/2006 | |
| WO | WO 2006/119392 | | 11/2006 | |
| WO | WO 2006/125517 | | 11/2006 | |
| WO | WO 2007/042192 | | 4/2007 | |
| WO | WO 2007/090461 | | 8/2007 | |
| WO | WO 2008/010187 | | 1/2008 | |
| WO | WO 2008/098037 | | 8/2008 | |
| WO | WO 2008/153565 | | 12/2008 | |
| WO | WO 2008/154073 | | 12/2008 | |
| WO | WO 2009/134746 | | 11/2009 | |
| WO | WO 2010/025224 | | 3/2010 | |
| WO | WO 2010/138941 | | 12/2010 | |
| WO | WO 2011/002956 | | 1/2011 | |
| WO | WO 2011/088889 | | 7/2011 | |
| WO | WO 2011/089123 | | 7/2011 | |
| WO | WO 2011/090425 | | 7/2011 | |

OTHER PUBLICATIONS

English-language abstract of JP 2003/096681.

The Chemistry and Processing of Wood and Plant Fibrous Materials, p. 155, Woodhead Publishing Ltd, Abington Hall, Abington, Cambridge CBI 6AH, England, J.F. Kennedy, et al. editors.

Burgess, "Relationships Between Colour Production in Cellulose and the Chemical Changes Brought About by Bleaching," Transcript of a Lecture given at the Meeting of the Book and Paper Specialty Group, AIC Annual Meeting, Milwaukee, May 27-30, 1982 (http://cool.conversation-us.org/coolaic/sg/bpg/annual/v01/bp01-05.html).

Zheng Dang et al., "Alkaline peroxide treatment of ECF bleached softwood kraft pulps. Part 1. Characterizing the effect of alkaline peroxide treatment on carboxyl groups of fibers," *Holzforschung*, vol. 61, pp. 445-450, 2007.

Zheng Dang, "The Investigation of Carboxyl Groups of Pulp Fibers During Kraft Pulping, Alkaline Peroxide Bleaching, and TEMPO-mediated Oxication,"*Georgia Institute of Technology*, Aug. 2007.

Easty et al., "Estimation of Pulp Yield in Continuous Digesters from Carbohydrate and Lignin Determinations," *TAPPI Journal*, 65(12):78-80 (1982).

Gullichsen, "Chemical Pulping," *Papermaking Science and Technology*, Book 6A, pp. A635-A665, 1992.

International Preliminary Report on Patentability dated Nov. 29, 2011, in PCT Application No. PCT/US2010/036763.

International Search Report dated Apr. 7, 2011, in International No. PCT/US2010/03673.

Kubelka et al., "Delignification with Acidic Hydrogen Peroxide Activated by Molybdate," *Journal of Pulp and Paper Science*, vol. 18, No. 3, May 1992, pp. J108-J114.

Luc Lapierre et al., "The Effect of Magnesium Ions and Chelants on Peroxide Bleaching," *Holzforschung*, vol. 57, No. 6, pp. 627-633, 2003.

Norden, Solveig et al., "Bleaching of Extremely Low Kappa Southern Pine, Cooked by the Superbatch™ Process," 1992 Pulping Conference, TAPPI Proceedings, 1992 Pulping Conference, pp. 159-168.

Qian, "The Chemical Mechanism of a Brown-Rot Decay Mimtic System and its Application in paper Recycling Processes," [Chapter 4: The Effects of Chelator Mediated Fenton System on the Fiber and Paper Properties of Hardwood Kraft Pulp], 2001, *Electronic Theses and Dissertations*, Paper 505.

Rohrling et al., "A novel method for the determination of carbonyl groups in cellulosics by fluorescence labeling. 2. Validation and applications," *Biomacromolecules*, 2002, Sep.-Oct.; 3(5): 969-975.

Sixta Editor, *Handbook of Pulp*, 2006, pp. 366-509.

Smook, G.A., *Handbook for Pulp & Paper Technologists* (3rd Edition), Chapter 7 (2003).

Song et al., "Novel antiviral activity of dialdehyde starch," *Electronic J. Biotech.*, vol. 12, No. 2, 2009.

Suchy et al., "Catalysis and Activation of Oxygen and Peroxide Delignification of Chemical Pulps; A Review," *Miscellaneous Report, Pulp and Paper Research Institute of Canada*, 1999, pp. 1-32.

TAPPI, T-525 om-92, 1992, TAPPI.

Adam Wojciak et al., "Direct Characterization of Hydrogen Peroxide Bleached Thermomechanical Pulp Using Spectroscopic Methods," *J. Phys. Chem. A.*, vol. 111, pp. 10530-10536, 2007.

International Search Report in International Application No. PCT/US2012/038685, dated Jul. 18, 2012(5 pages).

International Preliminary Report on Patentability in International Application No. PCT/US2012/038685, dated Nov. 26, 2013 (5 pages).

International Preliminary Report on Patentability in International Application No. PCT/US2013/035494, dated Oct. 21, 2014 (7 pages).

International Search Report in International Application No. PCT/US2013/021224, dated Apr. 26, 2013 (3 pages).

International Preliminary Report on Patentability in International Application No. PCT/US2013/021224, dated Oct. 21, 2014 (6 pages).

* cited by examiner

Surfactant Evaluation

| Sample No. | 20% control 80% SAPPI | 20% 050 80% SAPPI | 20% 075 80% SAPPI | 20% 100 80% SAPPI | 20% 150 80% SAPPI | SAPPI 100% |
|---|---|---|---|---|---|---|
| **Steeping Stage** | | | | | | |
| % NaOH | 17.8 | 17.8 | 17.8 | 17.8 | 17.8 | 17.8 |
| Temperature, °C | 45 | 45 | 45 | 45 | 45 | 45 |
| Time, min. | 30 | 30 | 30 | 30 | 30 | 30 |
| P.W.R. (Press Weight Ratio) | 2.95 | 2.95 | 2.95 | 2.95 | 2.95 | 2.95 |
| % Cellulose | 31.42 | 33.37 | 32.78 | 33.24 | 33.69 | 32.66 |
| % NaOH | 16.05 | 15.88 | 15.95 | 15.77 | 15.94 | 16.34 |
| % Na2CO3 | 0.03 | 0.25 | 0.52 | 0.45 | 0.26 | 0.25 |
| **Alkali Cellulose Stage** | | | | | | |
| Aging Temperature, °C | 46.5 | 46.5 | 46.5 | 46.5 | 46.5 | 46.5 |
| Aging Time, hrs | 7.0 | 7.0 | 7.0 | 7.0 | 7.0 | 7.0 |
| Final Viscosity, cps (Tappi T-230 -1% CED) | 10.53 | 10.86 | 10.31 | 10.60 | 10.18 | 9.35 |
| **Xanthation Stage** | | | | | | |
| % CS2 (carbon disufide) | 32.0 | 32.0 | 32.0 | 32.0 | 32.0 | 32.0 |
| Time, min. | 60 | 60 | 60 | 60 | 60 | 60 |
| Temperature, °C | 31 | 31 | 31 | 31 | 31 | 31 |
| 70% Vaccuum recovery, min | 59 | 54 | 47 | 52 | 48 | 4554 |
| **Mixing Stage** | | | | | | |
| % Cellulose | 9.0 | 9.0 | 9.0 | 9.0 | 9.0 | 9.0 |
| % NaOH Time, | 5.5 | 5.5 | 5.5 | 5.5 | 5.5 | 5.5 |
| min | 90 | 90 | 90 | 90 | 90 | 90 |
| Temperature, °C | 15 | 15 | 15 | 15 | 15 | 15 |
| **Viscose Solution Test Stage** | | | | | | |
| Temperature, °C | 18 | 18 | 18 | 18 | 18 | 18 |
| Time, hrs | 19 | 19 | 19 | 19 | 19 | 19 |
| Filterability (x 0.001), $mL^{-1}$ | 139 | 66 | 83 | 102 | 86 | 65 |
| Haze (x 0.001), $cm^{-1}$ | 215 | 72 | 72 | 102 | 90 | 141 |
| Clarity, cm | 6 | 6 | 9 | 7 | 9 | 8 |
| Salt index, mL | 4.5 | 4.5 | 4.5 | 4.5 | 4.5 | 4.5 |
| 19 hour Ball Fall, sec | 53 | 49 | 52 | 59 | 46 | 37 |

Figure 4

| Sample No. | 20% 100 80% SAPPI | 20% 150 80% SAPPI | 20% 050 80% SAPPI | 20% 075 80% SAPPI | 20% control 80% SAPPI | SAPPI 100% | 20% 200 80% SAPPI |
|---|---|---|---|---|---|---|---|
| **Alkali Cellulose Stage** | | | | | | | |
| Aging time, hrs Final | 7.0 | 7.0 | 7.0 | 7.0 | 7.0 | 7.0 | 7.0 |
| Viscosity, cps (Tappi T-230 -1% CED) | 10.60 | 10.18 | 10.86 | 10.31 | 10.53 | 9.35 | 10.45 |
| **Xanthation Stage** | | | | | | | |
| 70% Vaccuum recovery, min | 52 | 48 | 54 | 47 | 59 | 45 | 46 |
| **Viscose Solution Test Stage** | | | | | | | |
| Filterability (x 0.001), $mL^{-1}$ | 102 | 86 | 66 | 83 | 139 | 65 | 64 |
| Haze (x 0.001), $cm^{-1}$ | 102 | 90 | 72 | 72 | 215 | 141 | 83 |
| Clarity, cm | 7 | 9 | 6 | 9 | 6 | 8 | 11 |
| Salt index, mL | 4.5 | 4.5 | 4.5 | 4.5 | 4.5 | 4.5 | 4.5 |
| 19 hour Ball Fall, sec | 59 | 46 | 49 | 52 | 53 | 37 | 46 |

Figure 5

USE OF SURFACTANT TO TREAT PULP AND IMPROVE THE INCORPORATION OF KRAFT PULP INTO FIBER FOR THE PRODUCTION OF VISCOSE AND OTHER SECONDARY FIBER PRODUCTS

CROSS-REFERENCE TO RELATED APPLICATIONS

This is a national phase application based on PCT/US2013/035494, filed Apr. 5, 2013, which claims the benefit of U.S. Provisional Application No. 61/635,185, filed Apr. 18, 2012, each of which is incorporated herein by reference.

This disclosure relates to modified kraft fiber having improved distribution characteristic. More particularly, this disclosure relates to softwood fiber, e.g., southern pine fiber, that exhibits a unique set of characteristics, improving its performance over other fiber derived from kraft pulp and making it useful in applications that have heretofore been limited to expensive fibers (e.g., cotton or high alpha content sulfite pulp). Still more particularly, this disclosure relates to kraft pulp that has been treated with one or more surfactants to increase its substitutability for expensive fibers.

This disclosure relates to chemically modified cellulose fiber derived from bleached softwood that has a viscosity making it suitable for use as a chemical cellulose feedstock in the production of cellulose derivatives including cellulose ethers, esters, and viscose.

This disclosure also relates to methods for producing the improved fiber described. The fiber, as described, is subjected to unique digestion and unique oxygen delignification, followed by bleaching and the application of a surfactant to the pulp.

In one embodiment, the fiber may also be subjected to a catalytic oxidation treatment. In these embodiments, the fiber may be oxidized with a combination of hydrogen peroxide and iron or copper and then further bleached to provide a fiber with appropriate brightness characteristics, for example brightness comparable to standard bleached fiber. Further, at least one process is disclosed that can provide the improved beneficial characteristics mentioned above, without the introduction of costly added steps for post-treatment of the bleached fiber. In this less costly embodiment, the fiber can be oxidized in a single stage of a kraft process, such as a kraft bleaching process. Still a further embodiment relates to process including five-stage bleaching comprising a sequence of $D_0$E1D1E2D2, where stage four (E2) comprises the catalytic oxidation treatment.

Finally, this disclosure relates to secondary chemical products, e.g., viscose, cellulose ethers, cellulose esters, produced using the improved modified kraft fiber as described.

Cellulose fiber and derivatives are widely used in paper, absorbent products, food or food-related applications, pharmaceuticals, and in industrial applications. The main sources of cellulose fiber are wood pulp and cotton. The cellulose source and the cellulose processing conditions generally dictate the cellulose fiber characteristics, and therefore, the fiber's applicability for certain end uses. A need exists for cellulose fiber that is relatively inexpensive to process, yet is highly versatile, enabling its use in a variety of applications. Specifically, there is a need for a lower cost kraft fiber that can be more readily substituted in higher quantities for more expensive fiber in the production of cellulose derivatives, e.g., viscose.

Kraft fiber, produced by a chemical kraft pulping method, provides an inexpensive source of cellulose fiber that generally provides final products with good brightness and strength characteristics. As such, it is widely used in paper applications. However, standard kraft fiber has limited applicability in downstream applications, such as cellulose derivative production, due to the chemical structure of the cellulose resulting from standard kraft pulping and bleaching. In general, standard kraft fiber contains too much residual hemi-cellulose and other naturally occurring materials that may interfere with the subsequent physical and/or chemical modification of the fiber. Moreover, standard kraft fiber has limited chemical functionality, and is generally rigid and not highly compressible.

In the standard kraft process a chemical reagent referred to as "white liquor" is combined with wood chips in a digester to carry out delignification. Delignification refers to the process whereby lignin bound to the cellulose fiber is removed due to its high solubility in hot alkaline solution. This process is often referred to as "cooking." Typically, the white liquor is an alkaline aqueous solution of sodium hydroxide (NaOH) and sodium sulfide ($Na_2S$). Depending upon the wood species used and the desired end product, white liquor is added to the wood chips in sufficient quantity to provide a desired total alkali charge based on the dried weight of the wood.

Generally, the temperature of the wood/liquor mixture in the digester is maintained at about 145° C. to 170° C. for a total reaction time of about 1-3 hours. When digestion is complete, the resulting kraft wood pulp is separated from the spent liquor (black liquor) which includes the used chemicals and dissolved lignin, Conventionally, the black liquor is burnt in a kraft recovery process to recover the sodium and sulphur chemicals for reuse.

At this stage, the kraft pulp exhibits a characteristic brownish color due to lignin residues that remain on the cellulose fiber. Following digestion and washing, the fiber is often bleached to remove additional lignin and whiten and brighten the fiber. Because bleaching chemicals are much more expensive than cooking chemicals, typically, as much lignin as possible is removed during the cooking process. However, it is understood that these processes need to be balanced because removing too much lignin can increase cellulose degradation. The typical Kappa number (the measure used to determine the amount of residual lignin in pulp) of softwood after cooking and prior to bleaching is in the range of 28 to 32.

Following digestion and washing, the fiber is generally bleached in multi-stage sequences, which traditionally comprise strongly acidic and strongly alkaline bleaching steps, including at least one alkaline step at or near the end of the bleaching sequence. Bleaching of wood pulp is generally conducted with the aim of selectively increasing the whiteness or brightness of the pulp, typically by removing lignin and other impurities, without negatively affecting physical properties. Bleaching of chemical pulps, such as kraft pulps, generally requires several different bleaching stages to achieve a desired brightness with good selectivity. Typically, a bleaching sequence employs stages conducted at alternating pH ranges. This alternation aids in the removal of impurities generated in the bleaching sequence, for example, by solubilizing the products of lignin breakdown. Thus, in general, it is expected that using a series of acidic stages in a bleaching sequence, such as three acidic stages in sequence, would not provide the same brightness as alternating acidic/alkaline stages, such as acidic-alkaline-acidic. For instance, a typical DEDED sequence produces a brighter product than a DEDAD sequence (where A refers to an acid treatment).

Cellulose exists generally as a polymer chain comprising hundreds to tens of thousands of glucose units. Cellulose may be oxidized to modify its functionality. Various methods of oxidizing cellulose are known. In cellulose oxidation, hydroxyl groups of the glycosides of the cellulose chains can be converted, for example, to carbonyl groups such as aldehyde groups or carboxylic acid groups. Depending on the oxidation method and conditions used, the type, degree, and location of the carbonyl modifications may vary. It is known that certain oxidation conditions may degrade the cellulose chains themselves, for example by cleaving the glycosidic rings in the cellulose chain, resulting in depolymerization. In most instances, depolymerized cellulose not only has a reduced viscosity, but also has a shorter fiber length than the starting cellulosic material. When cellulose is degraded, such as by depolymerizing and/or significantly reducing the fiber length and/or the fiber strength, it may be difficult to process and/or may be unsuitable for many downstream applications. A need remains for methods of modifying cellulose fiber that may improve both carboxylic acid and aldehyde functionalities, which methods do not extensively degrade the cellulose fiber.

Various attempts have been made to oxidize cellulose to provide both carboxylic and aldehydic functionality to the cellulose chain without degrading the cellulose fiber. In many cellulose oxidation methods, it has been difficult to control or limit the degradation of the cellulose when aldehyde groups are present on the cellulose. Previous attempts at resolving these issues have included the use of multi-step oxidation processes, for instance site-specifically modifying certain carbonyl groups in one step and oxidizing other hydroxyl groups in another step, and/or providing mediating agents and/or protecting agents, all of which may impart extra cost and by-products to a cellulose oxidation process. Thus, there exists a need for methods of modifying cellulose that are cost effective and/or can be performed in a single step of a process, such as a kraft process.

In addition to the difficulties in controlling the chemical structure of cellulose oxidation products, and the degradation of those products, it is known that the method of oxidation may affect other properties, including chemical and physical properties and/or impurities in the final products. For instance, the method of oxidation may affect the degree of crystallinity, the hemi-cellulose content, the color, and/or the levels of impurities in the final product and the yellowing characteristics of the fiber. Ultimately, the method of oxidation may impact the ability to process the cellulose product for industrial or other applications.

Traditionally, kraft cellulose sources that were useful in the production of absorbent products or tissue were not also useful in the production of downstream cellulose derivatives, such as viscose, cellulose ethers and cellulose esters. The production of low viscosity cellulose derivatives from high viscosity cellulose raw materials, such as standard kraft fiber, has heretofore required additional manufacturing steps that add significant cost while imparting unwanted by-products and reducing the overall quality of the cellulose derivative. Cotton linter and high alpha cellulose content sulfite pulps are typically used in the manufacture of cellulose derivatives such as cellulose ethers and esters. However, production of cotton linters and sulfite fiber with a high degree of polymerization (DP) and/or viscosity is expensive due to 1) the cost of the starting material, in the case of cotton; 2) the high energy, chemical, and environmental costs of pulping and bleaching, in the case of sulfite pulps; and 3) the extensive purifying processes required, which applies in both cases. In addition to the high cost, there is a dwindling supply of sulfite pulps available to the market. Therefore, these fibers are very expensive, and have limited applicability in pulp and paper applications, for example, where higher purity or higher viscosity pulps may be required. For cellulose derivative manufacturers these pulps constitute a significant portion of their overall manufacturing cost. Thus, there exists a need for high purity, white, bright, stable, non-yellowing, low cost fibers, such as a kraft fiber, that may be used as a substitute for expensive starting fiber in the production of cellulose derivatives. More specifically, there is a need for a fiber that can replace a higher percentage of the expensive fibers that are currently required to make cellulose derivatives.

There is also a need for inexpensive cellulose materials that can be used in the manufacture of microcrystalline cellulose. Microcrystalline cellulose is widely used in food, pharmaceutical, cosmetic, and industrial applications, and is a purified crystalline form of partially depolymerized cellulose. The use of kraft fiber in microcrystalline cellulose production, without the addition of extensive post-bleaching processing steps, has heretofore been limited. Microcrystalline cellulose production generally requires a highly purified cellulosic starting material, which is acid hydrolyzed to remove amorphous segments of the cellulose chain. See U.S. Pat. No. 2,978,446 to Battista et al. and U.S. Pat. No. 5,346,589 to Braunstein et al. A low degree of polymerization of the chains upon removal of the amorphous segments of cellulose, termed the "level-off DP," is frequently a starting point for microcrystalline cellulose production and its numerical value depends primarily on the source and the processing of the cellulose fibers. The dissolution of the non-crystalline segments from standard kraft fiber generally degrades the fiber to an extent that renders it unsuitable for most applications because of at least one of 1) remaining impurities; 2) a lack of sufficiently long crystalline segments; or 3) it results in a cellulose fiber having too high a degree of polymerization, typically in the range of 200 to 400, to make it useful in the production of microcrystalline cellulose. Kraft fiber having an increased alpha cellulose content, for example, would be desirable, as the kraft fiber may provide greater versatility in microcrystalline cellulose production and applications.

In the present disclosure, surfactant treated fiber having an ultra low viscosity can be produced resulting in a pulp having improved properties that can more easily be incorporated into expensive fiber pulp used in the production of chemical cellulose, e.g., viscose. This surfactant treatment improves incorporation-allowing more kraft based fiber to be substituted for the expensive cotton linter and sulfite pulps.

The methods of the present disclosure result in products that have characteristics that are not seen in prior art fibers. Thus, the methods of the disclosure can be used to produce products that are superior to products of the prior art. In addition, the fiber of the present invention can be cost-effectively produced.

BRIEF DESCRIPTION OF THE DRAWING

FIG. 4. is a table showing fiber sample properties when surfactant treated fiber of the invention was used in vicose production.

FIG. 5 is a table showing additional production characteristics for surfactant treated fiber of the invention used in vicose production.

DESCRIPTION

I. Methods

Figure 1:
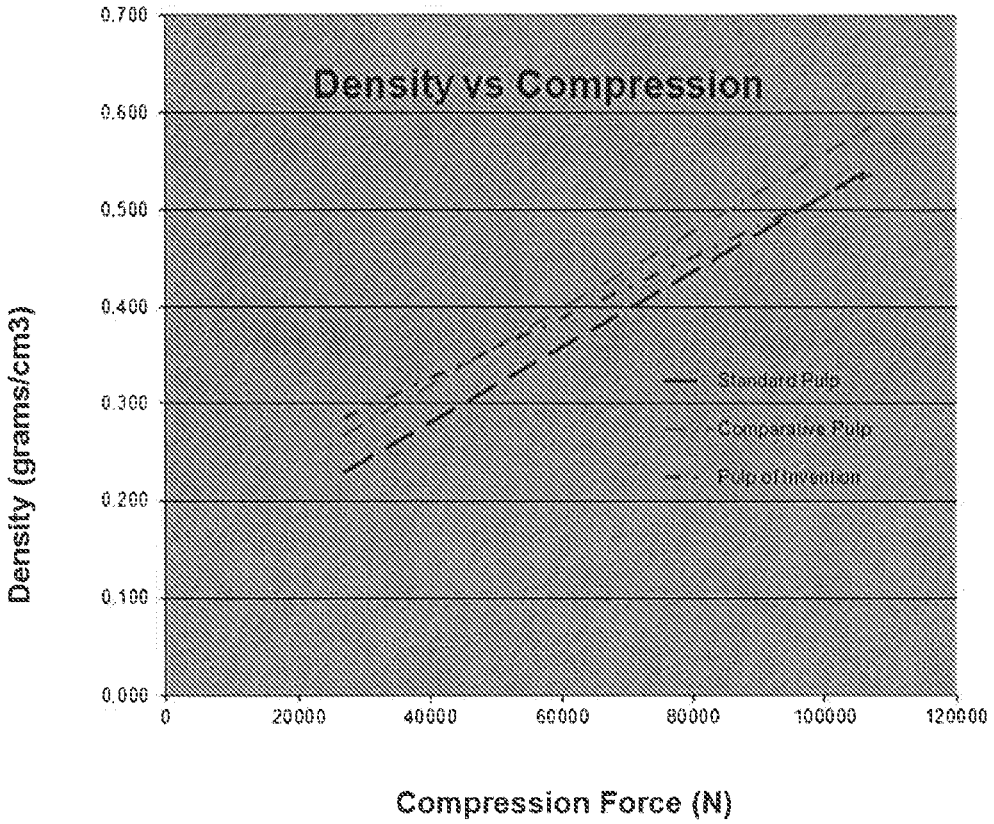
FIG. 1 is a graph of pulp fiber density as a function of compression.

The present disclosure provides novel methods for producing cellulose fiber. The method comprises subjecting cellulose to a kraft pulping step, an oxygen delignification step, and a bleaching sequence which, in certain embodiments, may include at least one catalytic oxidation stage followed by at least one bleaching stage and a surfactant treatment. In one embodiment, the fiber is subjected to the disclosed digestion, delignification and bleaching process without catalytic oxidation resulting in a fiber that, once treated with a surfactant, may be substituted for expensive cotton fiber or sulfite pulp at a greater rate and with more ease than was heretofore known. In another embodiment, the fiber is subjected to the disclosed digestion, delignification and bleaching process with catalytic oxidation resulting in a fiber that, once treated with a surfactant, may also be substituted for expensive cotton fiber or sulfite pulp at a greater rate and with more ease than was heretofore known but which also exhibits high brightness and low viscosity while reducing the tendency of the fiber to yellow upon exposure to heat, light and/or chemical treatment The cellulose fiber used in the methods described herein may be derived from softwood fiber, hardwood fiber, and mixtures thereof. In some embodiments, the modified cellulose fiber is derived from softwood, from any known source, including but not limited to, pine, spruce and fir. In some embodiments, the modified cellulose fiber is derived from hardwood, such as *eucalyptus*. In some embodiments, the modified cellulose fiber is derived from a mixture of softwood and hardwood. In yet another embodiment, the modified cellulose fiber is derived from cellulose fiber that has previously been subjected to all or part of a kraft process, i.e., kraft fiber.

References in this disclosure to "cellulose fiber," "kraft fiber," "pulp fiber" or "pulp" are interchangeable except where specifically indicated to be different or where one of ordinary skill in the art would understand them to be different. As used herein "modified kraft fiber," i.e., fiber which has been cooked, bleached and oxidized in accordance with the present disclosure may be used interchangeably with "kraft fiber" or "pulp fiber" to the extent that the context warrants it.

The present disclosure provides novel methods for treating cellulose fiber. In some embodiments, the disclosure provides a method of modifying cellulose fiber, comprising providing cellulose fiber, and oxidizing the cellulose fiber. As used herein, "oxidized," "catalytically oxidized," "catalytic oxidation" and "oxidation" are all understood to be interchangeable and refer to treatment of cellulose fiber with at least one metal catalyst, such as iron or copper and at least one peroxide, such as hydrogen peroxide, such that at least some of the hydroxyl groups of the cellulose fibers are oxidized. The phrase "iron or copper" and similarly "iron (or copper)" mean "iron or copper or a combination thereof." In some embodiments, the oxidation comprises simultaneously increasing carboxylic acid and aldehyde content of the cellulose fiber.

In one method of the invention, cellulose, preferably southern pine, is digested in a two-vessel hydraulic digester with, Lo-Solids® cooking to a kappa number ranging from about 17 to about 21. The resulting pulp is subjected to oxygen delignification until it reaches a kappa number of about 8 or below. The cellulose pulp is then bleached in a multi-stage bleaching sequence which may include at least one catalytic oxidation stage prior to the final bleach stage.

In one embodiment, the method comprises digesting the cellulose fiber in a continuous digester with a co-current, down-flow arrangement. The effective alkali ("EA") of the white liquor charge is at least about 15% on pulp, for example, at least about 15.5% on pulp, for example at least about 16% on pulp, for example, at least about 16.4% on pulp, for example at least about 17% on pulp. As used herein a "% on pulp" refers to an amount based on the dry weight of the kraft pulp. In one embodiment, the white liquor charge is divided with a portion of the white liquor being applied to the cellulose in the impregnator and the remainder of the white liquor being applied to the pulp in the digester. According to one embodiment, the white liquor is applied in a 50:50 ratio. In another embodiment, the white liquor is applied in a range of from 90:10 to 30:70, for example in a range from 50:50 to 70:30, for example 60:40. According to one embodiment, the white liquor is added to the digester in a series of stages. According to one embodiment, digestion is carried out at a temperature between about 160° C. to about 168° C., for example, from about 163° C. to about 168° C., for example, from about 166° C. to about 168° C., and the cellulose is treated until a target kappa number between about 17 and about 21 is reached. It is believed that the higher than normal effective alkali ("EA") and higher temperatures than used in the prior art achieve the lower than normal Kappa number.

According to one embodiment of the invention, the digester is run with an increase in push flow which increases the liquid to wood ratio as the cellulose enters the digester. This addition of white liquor is believed to assist in maintaining the digester at a hydraulic equilibrium and assists in achieving a continuous down-flow condition in the digester.

In one embodiment, the method comprises oxygen delignifying the cellulose fiber after it has been cooked to a kappa number from about 17 to about 21 to further reduce the lignin content and further reduce the kappa number, prior to bleaching. Oxygen delignification can be performed by any method known to those of ordinary skill in the art. For instance, oxygen delignification may be carried out in a conventional two-stage oxygen delignification process. Advantageously, the delignification is carried out to a target kappa number of about 8 or lower, more particularly about 6 to about 8.

In one embodiment, during oxygen delignification, the applied oxygen is less than about 3% on pulp, for example, less than about 2.4% on pulp, for example, less than about 2% on pulp. According to one embodiment, fresh caustic is added to the cellulose during oxygen delignification. Fresh caustic may be added in an amount of from about 2.5% on pulp to about 3.8% on pulp, for example, from about 3% on pulp to about 3.2% on pulp. According to one embodiment, the ratio of oxygen to caustic is reduced over standard kraft production; however the absolute amount of oxygen remains the same. Delignification may be carried out at a temperature of from about 93° C. to about 104° C., for example, from about 96° C. to about 102° C., for example, from about 98° C. to about 99° C.

After the fiber has reaches a Kappa Number of about 8 or less, the fiber is subjected to a multi-stage bleaching sequence. The stages of the multi-stage bleaching sequence may include any conventional or after discovered series of stages and may be conducted under conventional conditions. In at least one embodiment, the multi-stage bleaching sequence is a five-stage bleaching sequence. In some embodiments, the bleaching sequence is a DEDED sequence. In some embodiments, the bleaching sequence is a $D_0$E1D1E2D2 sequence. In some embodiments, the bleaching sequence is a $D_0$(EoP)D1E2D2 sequence. In some embodiments the bleaching sequence is a $D_0$(EO)D1E2D2.

In some embodiments, prior to bleaching the pH of the cellulose is adjusted to a pH ranging from about 2 to about 6, for example from about 2 to about 5 or from about 2 to about 4, or from about 2 to about 3.

The pH can be adjusted using any suitable acid, as a person of skill would recognize, for example, sulfuric acid or hydrochloric acid or filtrate from an acidic bleach stage of a bleaching process, such as a chlorine dioxide (D) stage of a multi-stage bleaching process. For example, the cellulose fiber may be acidified by adding an extraneous acid, Examples of extraneous acids are known in the art and include, but are not limited to, sulfuric acid, hydrochloric acid, and carbonic acid. In some embodiments, the cellulose fiber is acidified with acidic filtrate, such as waste filtrate, from a bleaching step. In at least one embodiment, the cellulose fiber is acidified with acidic filtrate from a D stage of a multi-stage bleaching process.

In some embodiments, the fiber, described, is subjected to a catalytic oxidation treatment. In some embodiments, the fiber is oxidized with iron or copper and then further bleached to provide a fiber with beneficial brightness characteristics. According to this embodiment, the multi-stage bleaching sequence can be any bleaching sequence that does not comprise an alkaline bleaching step following the oxidation step. In at least one embodiment, the multi-stage bleaching sequence is a five-stage bleaching sequence. In some embodiments, the bleaching sequence is a DEDED sequence. In some embodiments, the bleaching sequence is a $D_0$E1D1E2D2 sequence. In some embodiments, the bleaching sequence is a $D_0$(EoP)D1E2D2 sequence. In some embodiments the bleaching sequence is a $D_0$(EO)D1E2D2.

In some embodiments, the method comprises oxidizing the cellulose fiber in one or more stages of a multi-stage bleaching sequence. In some embodiments, the method comprises oxidizing the cellulose fiber in a single stage of a multi-stage bleaching sequence. In some embodiments, the method comprises oxidizing the cellulose fiber at or near the end of a multi-stage bleaching sequence. In some embodiments, the method comprises at least one bleaching step following the oxidation step. In some embodiments, the method comprises oxidizing cellulose fiber in the fourth stage of a five-stage bleaching sequence.

As discussed above, in accordance with the disclosure, oxidation of cellulose fiber involves treating the cellulose fiber with at least a catalytic amount of a metal catalyst, such as iron or copper and a peroxygen, such as hydrogen peroxide. In at least one embodiment, the method comprises oxidizing cellulose fiber with iron and hydrogen peroxide. The source of iron can be any suitable source, as a person of skill would recognize, such as for example ferrous sulfate (for example ferrous sulfate heptahydrate), ferrous chloride, ferrous ammonium sulfate, ferric chloride, ferric ammonium sulfate, or ferric ammonium citrate.

In some embodiments, the method comprises oxidizing the cellulose fiber with copper and hydrogen peroxide. Similarly, the source of copper can be any suitable source as a person of skill would recognize. Finally, in some embodiments, the method comprises oxidizing the cellulose fiber with a combination of copper and iron and hydrogen peroxide.

When cellulose fiber is oxidized in a bleaching step, cellulose fiber should not be subjected to substantially alkaline conditions in the bleaching process during or after the oxidation. In some embodiments, the method comprises oxidizing cellulose fiber at an acidic pH. In some embodiments, the method comprises providing cellulose fiber, acidifying the cellulose fiber, and then oxidizing the cellulose fiber at acidic pH. In some embodiments, the pH ranges from about 2 to about 6, for example from about 2 to about 5 or from about 2 to about 4.

The non-oxidation stages of a mufti-stage bleaching sequence may include any convention or after discovered series of stages, be conducted under conventional conditions, with the proviso that to be useful in producing the modified fiber described in the present disclosure, no alkaline bleaching step may follow the oxidation step.

In some embodiments, the oxidation is incorporated into the fourth stage of a multi-stage bleaching process. In some embodiments, the method is implemented in a five-stage bleaching process having a sequence of $D_0$E1D1E2D2, and the fourth stage (E2) is used for oxidizing kraft fiber.

In some embodiments, the kappa number increases after oxidation of the cellulose fiber. More specifically, one would typically expect a decrease in kappa number across this bleaching stage based upon the anticipated decrease in material, such as lignin, which reacts with the permanganate reagent. However, in the method as described herein, the kappa number of cellulose fiber may decrease because of the loss of impurities, e.g., lignin; however, the kappa number may increase because of the chemical modification of the fiber. Not wishing to be bound by theory, it is believed that the increased functionality of the modified cellulose provides additional sites that can react with the permanganate reagent. Accordingly, the kappa number of modified kraft fiber is elevated relative to the kappa number of standard kraft fiber.

In at least one embodiment, the oxidation occurs in a single stage of a bleaching sequence after both the iron or copper and peroxide have been added and some retention time provided. An appropriate retention is an amount of time that is sufficient to catalyze the hydrogen peroxide with the iron or copper. Such time will be easily ascertainable by a person of ordinary skill in the art.

In accordance with the disclosure, the oxidation is carried out for a time and at a temperature that is sufficient to produce the desired completion of the reaction. For example, the oxidation may be carried out at a temperature ranging from about 60 to about 80° C., and for a time ranging from about 40 to about 80 minutes. The desired time and temperature of the oxidation reaction will be readily ascertainable by a person of skill in the art.

According to one embodiment, the cellulose is subjected to a D(EoP)DE2D bleaching sequence. According to this embodiment, the first D stage ($D_0$) of the bleaching sequence is carried out at a temperature of at least about 57° C., for example at least about 60° C., for example, at least about 66° C., for example, at least about 71° C. and at a pH of less than about 3, for example about 2.5. Chlorine dioxide is applied in an amount of greater than about 0.6% on pulp, for example, greater than about 0.8% on pulp, for example about 0.9% on pulp. Acid is applied to the cellulose in an amount sufficient to maintain the pH, for example, in an amount of at least about 1% on pulp, for example, at least about 1.15% on pulp, for example, at least about 1.25% on pulp.

According to one embodiment, the first E stage ($E_1$), is carried out at a temperature of at least about 74° C., for example at least about 77° C., for example at least about 79° C., for example at least about 82° C., and at a pH of greater than about 11, for example, greater than 11.2, for example about 11.4. Caustic is applied in an amount of greater than about 0.7% on pulp, for example, greater than about 0.8% on pulp, for example about 1.0% on pulp. Oxygen is applied to the cellulose in an amount of at least about 0.48% on pulp, for example, at least about 0.5% on pulp, for example, at least about 0.53% on pulp. Hydrogen Peroxide is applied to the cellulose in an amount of at least about 0.35% on pulp, for example at least about 0.37% on pulp, for example, at least about 0.38% on pulp, for example, at least about 0.4% on pulp, for example, at least about 0.45% on pulp. The skilled artisan would recognize that any known peroxygen compound could be used to replace some or all of the hydrogen peroxide.

According to one embodiment of the invention, the kappa number after the D(EoP) stage is about 2.2 or less.

According to one embodiment, the second D stage ($D_1$) of the bleaching sequence is carried out at a temperature of at least about 74° C., for example at least about 77° C., for example, at least about 79° C. for example, at least about 82° C. and at a pH of less than about 4, for example less than 3.5, for example less than 3.2. Chlorine dioxide is applied in an amount of less than about 1% on pulp, for example, less than about 0.8% on pulp, for example about 0.7% on pulp. Caustic is applied to the cellulose in an amount effective to adjust to the desired pH, for example, in an amount of less than about 0.015% on pulp, for example, less than about 0.01% pulp, for example, about 0.0075% on pulp. The TAPPI viscosity of the pulp after this bleaching stage may be 9-12 mPa·s, for example.

According to one embodiment, the second E stage ($E_2$), is carried out at a temperature of at least about 74° C., for example at least about 79° C. and at a pH of greater than about 2.5, for example, greater than 2.9, for example about 3.3. An iron catalyst is added in, for example, aqueous solution at a rate of from about 25 to about 100 ppm $Fe^{+2}$, for example, from 25 to 75 ppm, for example, from 50 to 75 ppm, iron on pulp. Hydrogen Peroxide is applied to the cellulose in an amount of less than about 0.5% on pulp. The skilled artisan would recognize that any known peroxygen compound could be used to replace some or all of the hydrogen peroxide.

In accordance with the disclosure, hydrogen peroxide is added to the cellulose fiber in acidic media in an amount sufficient to achieve the desired oxidation and/or degree of polymerization and/or viscosity of the final cellulose product. For example, peroxide can be added as a solution at a concentration from about 1% to about 50% by weight in an amount of from about 0.1 to about 0.5%, or from about 0.1% to about 0.3%, or from about 0.1% to about 0.2%, or from about 0.2% to about 0.3%, based on the dry weight of the pulp.

Iron or copper are added at least in an amount sufficient to catalyze the oxidation of the cellulose with peroxide. For example, iron can be added in an amount ranging from about 25 to about 100 ppm based on the dry weight of the kraft pulp, for example, from 25 to 75 ppm, for example, from 50 to 75 ppm. A person of skill in the art will be able to readily optimize the amount of iron or copper to achieve the desired level or amount of oxidation and/or degree of polymerization and/or viscosity of the final cellulose product.

In some embodiments, the method further involves adding heat, such as through steam, either before or after the addition of hydrogen peroxide.

In some embodiments, the final DP and/or viscosity of the pulp can be controlled by the amount of iron or copper and hydrogen peroxide and the robustness of the bleaching conditions prior to the oxidation step. A person of skill in the art will recognize that other properties of the modified kraft fiber of the disclosure may be affected by the amounts of catalyst and peroxide and the robustness of the bleaching conditions prior to the oxidation step. For example, a person of skill in the art may adjust the amounts of iron or copper and hydrogen peroxide and the robustness of the bleaching conditions prior to the oxidation step to target or achieve a desired brightness in the final product and/or a desired degree of polymerization or viscosity.

In some embodiments, a kraft pulp is acidified on a D1 stage washer, the iron source (or copper source) is also added to the kraft pulp on the D1 stage washer, the peroxide is added following the iron source (or copper source) at an addition point in the mixer or pump before the E2 stage tower, the kraft pulp is reacted in the E2 tower and washed on the E2 washer, and steam may optionally be added before the E2 tower in a steam mixer.

In some embodiments, iron (or copper) can be added up until the end of the D1 stage, or the iron (or copper) can also be added at the beginning of the E2 stage, provided that the pulp is acidified first (i.e., prior to addition of the iron (or copper)) at the D1 stage. Steam may be optionally added either before or after the addition of the peroxide.

For example, in some embodiments, the treatment with hydrogen peroxide in an acidic media with iron (or copper) may involve adjusting the pH of the kraft pulp to a pH ranging from about 2 to about 5, adding a source of iron (or copper) to the acidified pulp, and adding hydrogen peroxide to the kraft pulp.

According to one embodiment, the third D stage ($D_2$) of the bleaching sequence is carried out at a temperature of at least about 74° C., for example at least about 77° C., for example, at least about 79° C., for example, at least about 82° C. and at a pH of less than about 4, for example less than about 3.8. Chlorine dioxide is applied in an amount of less than about 0.5% on pulp, for example, less than about 0.3% on pulp, for example about 0.15% on pulp.

Alternatively, the multi-stage bleaching sequence may be altered to provide more robust bleaching conditions prior to oxidizing the cellulose fiber. In some embodiments, the method comprises providing more robust bleaching conditions prior to the oxidation step. More robust bleaching conditions may allow the degree of polymerization and/or viscosity of the cellulose fiber to be reduced in the oxidation step with lesser amounts of iron or copper and/or hydrogen peroxide. Thus, it may be possible to modify the bleaching sequence conditions so that the brightness and/or viscosity of the final cellulose product can be further controlled. For instance, reducing the amounts of peroxide and metal, while providing more robust bleaching conditions before oxidation, may provide a product with lower viscosity and higher brightness than an oxidized product produced with identical oxidation conditions but with less robust bleaching. Such conditions may be advantageous in some embodiments, particularly in cellulose ether applications.

In some embodiments, for example, the method of preparing a modified cellulose fiber within the scope of the disclosure may involve acidifying the kraft pulp to a pH ranging from about 2 to about 5 (using for example sulfuric acid). mixing a source of iron (for example ferrous sulfate, for example ferrous sulfate heptahydrate) with the acidified kraft pulp at an application of from about 25 to about 250 ppm $Fe^{+2}$ based on the dry weight of the kraft pulp at a consistency ranging from about 1% to about 15% and also hydrogen peroxide, which can be added as a solution at a concentration of from about 1% to about 50% by weight and in an amount ranging from about 0.1% to about 1.5% based on the dry weight of the kraft pulp. In some embodiments, the ferrous sulfate solution is mixed with the kraft pulp at a consistency ranging from about 7% to about 15%. In some embodiments the acidic kraft pulp is mixed with the iron source and reacted with the hydrogen peroxide for a time period ranging from about 40 to about 80 minutes at a temperature ranging from about 60 to about 80° C.

In some embodiments, each stage of the five-stage bleaching process includes at least a mixer, a reactor, and a washer (as is known to those of skill in the art).

According to one embodiment, the density of kraft fiber as a function of compressive force can be seen in FIG. 1. Figure shows the change in density of a pulp fiber under compressive force. The graph compares the pulp fiber of the invention with a fiber made in accordance with the comparative Example 4, and with a standard fluff pulp. As can be seen from the graph, the pulp fiber of the invention is more compressible than standard fluff pulp.

Figure 2:
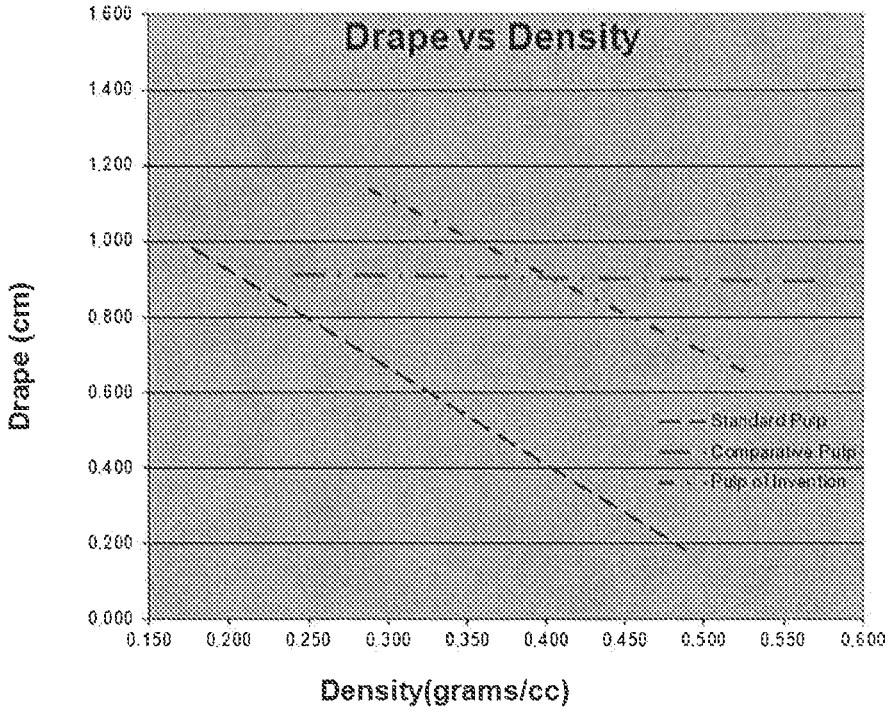
FIG. 2 is a graph of drape as a function of density.

According to one embodiment, the drape of the pulp fiber as a function of density can be seen in FIG. 2. FIG. 2 shows the drape of the pulp fiber as its density is increased. The graph compares the pulp fiber of the invention with a fiber made in accordance with the comparative Example 4, and with a standard fluff pulp. As can be seen from the graph, the pulp fiber of the invention shows a drape that is significantly better than that seen in standard fluff pulp. Further, at low densities, the fiber of the invention has better drape than the pulp fiber of the comparative example.

In at least one embodiment, the method comprises providing cellulose fiber, partially bleaching the cellulose fiber, and oxidizing the cellulose fiber. In some embodiments, the oxidation is conducted in the bleaching process. In some embodiments, the oxidation is conducted after the bleaching process.

Fiber produced as described is treated with a surface active agent. The surface active agent for use in the present invention may be solid or liquid. The surface active agent can be any surface active agent, including by not limited to softeners, debonders, and surfactants that is not substantive to the fiber, i.e., which does not interfere with its specific absorption rate. As used herein a surface active agent that is "not substantive" to the fiber exhibits an increase in specific absorption rate of 30% or less as measured using the pfi test as described herein. According to one embodiment, the specific absorption rate is increased by 25% or less, such as 20% or less, such as 15% or less, such as 10% or less. Not wishing to be bound by theory, the addition of surfactant causes competition for the same sites on the cellulose as the test fluid. Thus, when a surfactant is too substantive, it reacts at too many sites reducing the absorption capability of the fiber.

As used herein PFI is measured according to SCAN-C-33:80 Test Standard, Scandinavian Pulp, Paper and Board Testing Committee. The method is generally as follows. First, the sample is prepared using a PFI Pad Former. Turn on the vacuum and feed approximately 3.01 g fluff pulp into the pad former inlet. Turn off the vacuum, remove the test piece and place it on a balance to check the pad mass. Adjust the fluff mass to 3.00±0.01 g and record as $Mass_{dry}$. Place the fluff Into the test cylinder. Place the fluff containing cylinder in the shallow perforated dish of an Absorption Tester and turn the water valve on. Gently apply a 500 g load to the fluff pad while lifting the test piece cylinder and promptly press the start button. The Tester will fun for 30 s before the display will read 00.00. When the display reads 20 seconds, record the dry pad height to the nearest 0.5 mm ($Height_{dry}$). When the display again reads 00.00, press the start button again to prompt the tray to automatically raise the water and then record the time display (absorption time, T), The Tester will continue to run for 30 seconds. The water tray will automatically lower and the time will run for another 30S. When the display reads 20 s, record the wet pad height to the nearest 0.5 mm ($Height_{wet}$). Remove the sample holder, transfer the wet pad to the balance for measurement of $Mass_{wet}$ and shut off the water valve. Specific Absorption Rate (s/g) is $T/Mass_{dry}$. Specific Capacity (g/g) is $(Mass_{wet}-Mass_{dry})/Mass_{dry}$. Wet Bulk (cc/g) is $[19.64\ cm^2 \times Height_{wet}/3]/10$. Dry Bulk is $[19.64\ cm^2 \times Height_{dry}/3]/10$. The reference standard for comparison with the surfactant treated fiber is an identical fiber without the addition of surfactant.

It is generally recognized that softeners and debonders are often available commercially only as complex mixtures rather than as single compounds. While the following discussion will focus on the predominant species, it should be understood that commercially available mixtures would generally be used in practice. Suitable softener, debonder and surfactants will be readily apparent to the skilled artisan and are widely reported in the literature.

Suitable surfactants include cationic surfactants, anionic, and nonionic surfactants that are not substantive to the fiber. According to one embodiment, the surfactant is a nonionic surfactant. According to one embodiment, the surfactant is a cationic surfactant. According to one embodiment, the surfactant is a vegetable based surfactant, such as a vegetable based fatty acid, such as a vegetable based fatty acid quaternary ammonium salt. Such compounds include DB999 and DB1009, both available from Cellulose Solutions. Other surfactants may be including, but not limited to Berol 388 an ethoxylated nonylphenol ether from Akzo Nobel.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

The surfactant is added in an amount of up to 6 lbs/ton, such as from 0.5 lbs/ton to 3 lbs/ton, such as from 0.5 lbs/ton to 2.5 lbs/ton such as from 0.5 lbs/ton to 2 lbs/ton, such as less than 2 lbs/ton.

The surface active agent may be added at any point prior to forming rolls, bales, or sheets of pulp. According to one embodiment, the surface active agent is added just prior to the headbox of the pulp machine, specifically at the inlet of the primary cleaner feed pump.

According to one embodiment, the fiber of the present invention has an improved filterability when utilized in a viscose process. For example, the filterability of a viscose solution comprising fiber of the invention has a filterability that is at least 10% lower than a viscose solution made in the same way with the identical fiber without surfactant, such as at least 15% lower, such as at least 30% lower, such as at least 40% lower. Filterability of the viscose solution is measured by the following method. A solution is placed in a nitrogen pressurized (27 psi) vessel with a 1 and 3/16ths inch filtered orifice on the bottom—the filter media is as follows from outside to inside the vessel: a perforated metal disk, a 20 mesh stainless steel screen, muslin cloth, a Whatman 54 filter paper and a 2 layer knap flannel with the fuzzy side up toward the contents of the vessel. For 40 minutes the solution is allowed to filter through the media, then at 40 minutes for an additional 140 minutes the (so t=0 at 40 minutes) the volume of filtered solution is measured (weight) with the elapsed time as the X coordinate and the weight of filtered viscose as the Y coordinate—the slope of this plot is your filtration number. Recordings to be made at 10 minute intervals. The reference standard for comparison with the surfactant treated fiber is the identical fiber without the addition of surfactant.

According to one embodiment of the invention, the surfactant treated fiber of the invention exhibits a limited increase in specific absorption rate, e.g., less than 30% with a concurrent decrease in filterability, e.g., at least 10%. According to one embodiment, the surfactant treated fiber has an increased specific absorption rate of less than 30% and a decreased filterability of at least 20%, such as at least 30%, such as at least 40%. According to another embodiment, the surfactant treated fiber has an increased specific absorption rate of less than 25% and a decreased filterability of at least 10%, such as at least about 20%, such as at least 30%, such as at least 40%, According to yet another embodiment, the surfactant treated fiber has an increased specific absorption rate of less than 20% and a decreased filterability of at least 10%, such as at least about 20%, such as at least 30%, such as at least 40%. According to another embodiment, the surfactant treated fiber has an increased specific absorption rate of less than 15% and a decreased filterability of at least 10%, such as at least about 20%, such as at least 30%, such as at least 40%. According to still another embodiment, the surfactant treated fiber has an increased specific absorption rate of less than 10% and an decreased filterability of at least 10%, such as at least about 20%, such as at least 30%, such as at least 40%.

Heretofore the addition of cationic surfactant to pulp bound for the production of viscose was considered detrimental to viscose production. Cationic surfactants attach to the same sites on the cellulose that caustic must react with to begin the breakdown of the cellulose fiber. Thus, it has long been thought that cationic materials should not be used as pulp pre-treatments for fibers used in the production of viscose. Not wishing to be bound by theory it is believed that since the fibers produced according to the present invention differs from prior art fiber in their form, character and chemistry, the cationic surfactant is not binding in the same manner as it did to prior art fibers. Fiber according to the disclosure, when treated with a surfactant according to the invention separates the fiber in a way that improves caustic penetration and filterability. Thus, the fibers of the present disclosure can be used as a substitute for expensive cotton or sulfite fiber to a greater extent than either untreated fiber or prior art fiber has been.

II. Kraft Fibers

Reference is made herein to "standard," "conventional," or "traditional," kraft fiber, kraft bleached fiber, kraft pulp or kraft bleached pulp. Such fiber or pulp is often described as a reference point for defining the improved properties of the present invention. As used herein, these terms are interchangeable and refer to the fiber or pulp which is identical in composition but processed in a standard manner. As used herein, a standard kraft process includes both a cooking stage and a bleaching stage under art recognized conditions. Standard kraft processing does not include a pre-hydrolysis stage prior to digestion.

Physical characteristics (for example, purity, brightness, fiber length and viscosity) of the kraft cellulose fiber mentioned in the specification are measured in accordance with protocols provided in the Examples section.

In some embodiments, modified kraft fiber of the disclosure has a brightness equivalent to standard kraft fiber. In some embodiments, the modified cellulose fiber has a brightness of at least 85%, 86%, 87%, 88%, 89%, or 90% ISO. In some embodiments, the brightness is about 91%, about 92% or about 93% ISO. In some embodiments, the brightness ranges from about 85% to about 93%, or from about 86% to about 91%, or from about 87% to about 91%, or from about 88% to about 91% ISO.

In some embodiments, cellulose according to the present disclosure has an R18 value in the range of from about 84% to about 91%. For instance R18 has a value of at least about 88%, such as at least about 89%, quite surprising for a pulp that has not been pre-hydrolyzed or made from a sulfite process.

The R18 content is described in TAPPI T235. R18 represents the residual amount of undissolved material left after extraction of the pulp with an 18% caustic solution, Generally only hemicellulose is dissolved and removed in an 18% caustic solution.

In some embodiments, modified cellulose fiber has an S18 caustic solubility ranging from about 14% to about 16%, or from about 14.5% to about 15.5%. In some embodiments, modified cellulose fiber has an S18 caustic solubility ranging from about 11.5% to about 14%, or from about 12% to about 13%.

The present disclosure provides kraft fiber with low and ultra-low viscosity. Unless otherwise specified, "viscosity" as used herein refers to 0.5% Capillary CED viscosity measured according to TAPPI T230-om99 as referenced in the protocols.

"DP" as used in the examples refers to average degree of polymerization by weight (DPw) calculated from 0.5% Capillary CED viscosity measured according to TAPPI T230-om99. See, e.g., J. F. Cellucon Conference in *The Chemistry and Processing of Wood and Plant Fibrous Materials*, p. 155, test protocol 8, 1994 (Woodhead Publishing Ltd., Abington Hall, Abinton Cambridge CBI 6AH England, J. F. Kennedy et al. eds.) Low viscosity ranges from about 7 to about 13 mPa·s and "ultra low viscosity" ranges from about 3 to about 7 mPa·s.

In one embodiment, modified cellulose fiber has a viscosity ranging from about 4.0 mPa·s to about 6 mPa·s. In some embodiments, the viscosity ranges from about 4.0 mPa·s to about 5.5 mPa·s. In some embodiments, the viscosity ranges from about 4.5 mPa·s to about 5.5 mPa·s. In some embodiments, the viscosity ranges from about 5.0 mPa·s to about 5.5 mPa·s. In some embodiments, the viscosity is less than 6 mPa·s, less than 5.5 mPa·s, less than 5.0 mPa·s, or less than 4.5 mPa·s.

In another embodiment, modified cellulose fiber has a viscosity ranging from about 7.0 mPa·s to about 10 mPa·s. In some embodiments, the viscosity ranges from about 7.5 mPa·s to about 10 mPa·s. In some embodiments, the viscosity ranges from about 7.0 mPa·s to about 8.0 mPa·s. In some embodiments, the viscosity ranges from about 7.0 mPa·s to about 7.5 mPa·s. In some embodiments, the viscosity is less than 10 mPa·s, less than 8 mPa·s, less than 7.5 mPa·s, less than 7 mPa·s, or less than 6.5 mPa·s.

The modified kraft fiber of some embodiments according to the present disclosure can also exhibits an improved anti-yellowing characteristic when compared to other ultra-low viscosity fibers. The modified kraft fibers of the present invention have a b* color value, in the NaOH saturated state, of less than about 30, for example less than about 27, for example less than about 25, for example less than about 22. The test for b* color value in the saturated state is as follows: Samples are cut into 3"×3" squares. Each of the squares is placed separately in a tray and 30 mls of 18% NaOH is added to saturate the sheet. The square is then removed from the tray and NaOH solution after 5 minutes, at which time it is in "the NaOH saturated state." The brightness and color values are measured on the saturated sheet. The brightness and color values as CIE L*, a*, b* coordinates were determined on a Hunterlab MiniScan™ XE instrument. Alternatively, the anti-yellowing characteristic can be represented as the difference between the b* color of the sheet before saturation and after saturation. See Example 5, below. The sheet that changes the least has the best anti-yellowing characteristics. The modified kraft fiber of the invention has a Δb* of less than about 25, for example, less than about 22, for example less than about 20, for example less than about 18.

In some embodiments, kraft fiber of the disclosure maintains its fiber length during the bleaching process. "Fiber length" and "average fiber length" are used interchangeably when used to describe the property of a fiber and mean the length-weighted average fiber length. Therefore, for example, a fiber having an average fiber length of 2 mm should be understood to mean a fiber having a length-weighted average fiber length of 2 mm.

In some embodiments, when the kraft fiber is a softwood fiber, the cellulose fiber has an average fiber length, as measured in accordance with Test Protocol 12, described in the Example section below, that is about 2 mm or greater. In some embodiments, the average fiber length is no more than about 3.7 mm. In some embodiments, the average fiber length is at least about 2.2 mm, about 2.3 mm, about 2.4 mm, about 2.5 mm, about 2.6 mm, about 2.7 mm, about 2.8 mm, about 2.9 mm, about 3.0 mm, about 3.1 mm, about 3.2 mm, about 3.3 mm, about 3.4 mm, about 3.5 mm, about 3.6 mm, or about 3.7 mm. In some embodiments, the average fiber length ranges from about 2 mm to about 3.7 mm, or from about 2.2 mm to about 3.7 mm.

In some embodiments, modified kraft fiber of the disclosure has increased carboxyl content relative to standard kraft fiber.

In some embodiments, modified cellulose fiber has a carboxyl content ranging from about 2 meq/100 g to about 4 meq/100 g. In some embodiments, the carboxyl content ranges from about 3 meq/100 g to about 4 meq/100 g. In some embodiments, the carboxyl content is at least about 2 meq/100 g, for example, at least about 2.5 meq/100 g, for example, at least about 3.0 meq/100 g, for example, at least about 3.5 meq/100 g.

In some embodiments, modified cellulose fiber has a carbonyl content ranging from about 1.5 meq/100 g to about 2.5 meq/100 g. In some embodiments, the carbonyl content ranges from about 1.5 meq/100 g to about 2 meq/100 g. In some embodiments, the carbonyl content is less than about 2.5 meq/100 g, for example, less than about 2.0 meq/100 g, for example, less than about 1.5 meq/100 g.

In some embodiments, the modified cellulose fiber has a copper number less than about 2. In some embodiments, the copper number is less than about 1.5. In some embodiments, the copper number is less than about 1.3. In some embodiments, the copper number ranges from about 1.0 to about 2.0, such as from about 1.1 to about 1.5.

In at least one embodiment, the hemicellulose content of the modified kraft fiber is substantially the same as standard unbleached kraft fiber. For example, the hemicellulose content for a softwood kraft fiber may range from about 12% to about 17%. For instance, the hemicellulose content of a hardwood kraft fiber may range from about 12.5% to about 16.5%.

III. Products Made from Kraft Fibers

The present disclosure provides products made from the modified kraft fiber described herein. In some embodiments, the products are those typically made from standard kraft fiber. In other embodiments, the products are those typically made from cotton linter, pre-hydrolsis kraft or sulfite pulp. More specifically, fiber of the present invention can be used, without further modification, as a starting material in the preparation of chemical derivatives, such as ethers and esters. Heretofore, fiber has not been available which has been useful to replace both high alpha content cellulose, such as cotton and sulfite pulp, as well as traditional kraft fiber.

Phrases such as "which can be substituted for cotton linter (or sulfite pulp) . . . " and "interchangeable with cotton linter (or sulfite pulp) . . . " and "which can be used in place of cotton linter (or sulfite pulp) . . . " and the like mean only that the fiber has properties suitable for use in the end application normally made using cotton linter (or sulfite pulp or pre-hydrolysis kraft fiber). The phrase is not intended to mean that the fiber necessarily has all the same characteristics as cotton linter (or sulfite pulp).

In some embodiments, this disclosure provides a modified kraft fiber that can be used as a substitute for cotton linter or sulfite pulp. In some embodiments, this disclosure provides a modified kraft fiber that can be used as a substitute for cotton linter or sulfite pulp, for example in the manufacture of cellulose ethers, cellulose acetates and microcrystalline cellulose.

Without being bound by theory, it is believed that the increase in aldehyde content relative to conventional kraft pulp provides additional active sites for etherification to end-products such as carboxymethylcellulose, methylcellulose, hydroxypropylcellulose, and the like, while simultaneously reducing the viscosity without imparting significant yellowing or discoloration, enabling production of a fiber that can be used for both papermaking and cellulose derivatives.

In some embodiments, the modified kraft fiber has chemical properties that make it suitable for the manufacture of cellulose ethers. Thus, the disclosure provides a cellulose ether derived from a modified kraft fiber as described. In some embodiments, the cellulose ether is chosen from ethylcellulose, methylcellulose, hydroxypropyl cellulose, carboxymethyl cellulose, hydroxypropyl methylcellulose, and hydroxyethyl methyl cellulose. It is believed that the cellulose ethers of the disclosure may be used in any application where cellulose ethers are traditionally used. For example, and not by way of limitation, the cellulose ethers of the disclosure may be used in coatings, inks, binders, controlled release drug tablets, and films.

In some embodiments, the modified kraft fiber has chemical properties that make it suitable for the manufacture of cellulose esters. Thus, the disclosure provides a cellulose ester, such as a cellulose acetate, derived from modified kraft fibers of the disclosure. In some embodiments, the disclosure provides a product comprising a cellulose acetate derived from the modified kraft fiber of the disclosure. For example, and not by way of limitation, the cellulose esters of the disclosure may be used in, home furnishings, cigarette filters, inks, absorbent products, medical devices, and plastics including, for example, LCD and plasma screens and windshields.

In some embodiments, the modified kraft fiber of the disclosure may be suitable for the manufacture of viscose. More particularly, the modified kraft fiber of the disclosure may be used as a partial substitute for expensive cellulose starting material. The modified kraft fiber of the disclosure may replace as much as 35% or more, for example as much as 20%, for example as much as 10%, of the expensive cellulose starting materials, Thus, the disclosure provides a viscose fiber derived in whole or in part from a modified kraft fiber as described. In some embodiments, the viscose is produced from modified kraft fiber of the present disclosure that is treated with alkali and carbon disulfide to make a solution called viscose, which is then spun into dilute sulfuric acid and sodium sulfate to reconvert the viscose into cellulose. It is believed that the viscose fiber of the disclosure may be used in any application where viscose fiber is traditionally used. For example, and not by way of limitation, the viscose of the disclosure may be used in rayon, cellophane, filament, food casings, and tire cord.

In some embodiments, the modified kraft of the present disclosure, without further modification, can be used in the manufacture of cellulose ethers (for example carboxymethylcellulose) and esters as a whole or partial substitute for fiber derived from cotton linters and from bleached softwood fibers produced by the acid sulfite pulping process.

In some embodiments, this disclosure provides a modified kraft fiber that can be used as a whole or partial substitute for cotton linter or sulfite pulp. In some embodiments, this disclosure provides a modified kraft fiber that can be used as a substitute for cotton linter or sulfite pulp, for example in the manufacture of cellulose ethers, cellulose acetates, viscose, and microcrystalline cellulose.

In some embodiments, the kraft fiber is suitable for the manufacture of cellulose ethers. Thus, the disclosure provides a cellulose ether derived from a kraft fiber as described. In some embodiments, the cellulose ether is chosen from ethylcellulose, methylcellulose, hydroxypropyl cellulose, carboxymethyl cellulose, hydroxypropyl methylcellulose, and hydroxyethyl methyl cellulose. It is believed that the cellulose ethers of the disclosure may be used in any application where cellulose ethers are traditionally used. For example, and not by way of limitation, the cellulose ethers of the disclosure may be used in coatings, inks, binders, controlled release drug tablets, and films.

In some embodiments, the kraft fiber is suitable for the manufacture of cellulose esters. Thus, the disclosure provides a cellulose ester, such as a cellulose acetate, derived from kraft fibers of the disclosure. In some embodiments, the disclosure provides a product comprising a cellulose acetate derived from the kraft fiber of the disclosure. For example, and not by way of limitation, the cellulose esters of the disclosure may be used in home furnishings, cigarette filters, inks, absorbent products, medical devices, and plastics including, for example, LCD and plasma screens and windshields.

In some embodiments, the kraft fiber is suitable for the manufacture of microcrystalline cellulose. Microcrystalline cellulose production requires relatively clean, highly purified starting cellulosic material. As such, traditionally, expensive sulfite pulps have been predominantly used for its production. The present disclosure provides microcrystalline cellulose derived from kraft fiber of the disclosure. Thus, the disclosure provides a cost-effective cellulose source for microcrystalline cellulose production.

The cellulose of the disclosure may be used in any application that microcrystalline cellulose has traditionally been used. For example, and not by way of limitation, the cellulose of the disclosure may be used in pharmaceutical or nutraceutical applications, food applications, cosmetic applications, paper applications, or as a structural composite. For instance, the cellulose of the disclosure may be a binder, diluent, disintegrant, lubricant, tabletting aid, stabilizer, texturizing agent, fat replacer, bulking agent, anticaking agent, foaming agent, emulsifier, thickener, separating agent, gelling agent, carrier material, opacifier, or viscosity modifier. In some embodiments, the microcrystalline cellulose is a colloid.

Other products comprising cellulose derivatives and microcrystalline cellulose derived from kraft fibers according to the disclosure may also be envisaged by persons of ordinary skill in the art. Such products may be found, for example, in cosmetic and industrial applications.

As used herein, "about" is meant to account for variations due to experimental error. All measurements are understood to be modified by the word "about", whether or not "about" is explicitly recited, unless specifically stated otherwise, Thus, for example, the statement "a fiber having a length of 2 mm" is understood to mean "a fiber having a length of about 2 mm."

The details of one or more non-limiting embodiments of the invention are set forth in the examples below. Other embodiments of the invention should be apparent to those of ordinary skill in the art after consideration of the present disclosure.

EXAMPLES

Test Protocols

1. Caustic solubility (R10, S10, R18, S18) is measured according to TAPPI T235-cm00.
2. Carboxyl content is measured according to TAPPI T237-cm98.
3. Aldehyde content is measured according to Econotech Services LTD, proprietary procedure ESM 055B.
4. Copper Number is measured according to TAPPI T430-cm99.
5. Carbonyl content is calculated from Copper Number according to the formula: carbonyl=(Cu. No. 0.07)/0.6, from *Biomacromolecules* 2002, 3, 969-975.
6. 0.5% Capillary CED Viscosity is measured according to TAPPI T230-om99.
7. Intrinsic Viscosity is measured according to ASTM D1795 (2007).
8. DP is calculated from 0.5% Capillary CED Viscosity according to the formula: DPw=−449.6+598.4 ln(0.5% Capillary CED)+118.02 $\ln^2$ (0.5% Capillary CED), from the 1994 Cellucon Conference published in *The Chemistry and Processing Of Wood And Plant Fibrous Materials*, p. 155, woodhead Publishing Ltd, Abington Hall, Abington, Cambridge CBI 6AH, England, J. F. Kennedy, et al. editors.
9. Carbohydrates are measured according to TAPPI T249-cm00 with analysis by Dionex ion chromatography.
10. Cellulose content is calculated from carbohydrate composition according to the formula: Cellulose=Glucan-(Mannan/3), from *TAPPI Journal* 65(12):78-80 1982.

11. Hemicellulose content is calculated from the sum of sugars minus the cellulose content.
12. Fiber length and coarseness is determined on a Fiber Quality Analyzer™ from OPTEST, Hawkesbury, Ontario, according to the manufacturer's standard procedures.
13. DCM (dichloromethane) extractives are determined according to TAPPI T204-cm97.
14. Iron content is determined by acid digestion and analysis by ICP.
15. Ash content is determined according to TAPPI T211-om02.
16. Brightness is determined according to TAPPI T525-om02.
17. CIE Whiteness is determined according to TAPPI Method T560
18. Mullen Burst is determined according to TAPPI T807
19. PFI is measured as described as described above.
20. Filterability is measured as described above.

Example 1

Southern pine cellulose was digested in a continuous digester with co-current liquor flow operating at a pulp production rate of 1599 T/D. 16.7% effective alkali was added to the pulp. The white liquor charge was distributed between the impregnator and the digester with one half of the charge being applied in each. A kappa number of 20.6 was reached.

The cellulose fiber was then washed and oxygen delignified in a conventional two-stage oxygen delignification process. Oxygen was applied at a rate of 1.6% and caustic was applied at a rate of 2.1%. Delignification was carried out at a temperature of 205.5°. The Kappa number as measure at the blend chest was 7.6.

The delignified pulp was bleached in a five-stage bleach plant, with a sequence of D(EOP)D(EP)D. The first D stage ($D_0$) was carried out at a temperature of 144.3° F. and at a pH of 2.7. Chlorine dioxide was applied in an amount of 0.9%. Acid was applied in an amount of 17.8 lbs/ton.

The first E stage ($E_1$), was carried out at a temperature of 162.9° F. and at a pH of 11.2. Caustic was applied in an amount of 0.8%. Oxygen was applied in an amount of 10.8 lbs/ton. Hydrogen Peroxide was application in an amount of 6.7 lbs/ton.

The second D stage ($D_1$) was carried out at a temperature of about 161.2° F. and at a pH of 3.2. Chlorine dioxide was applied in an amount of 0.7%. Caustic was applied in an amount of 0.7 lbs/ton.

The second E stage ($E_2$) was carried out at a temperature of 164.8° F. and at a pH of 10.7. Caustic was applied in an amount of 0.15%. Hydrogen peroxide was in an amount of 0.14%.

The third D stage ($D_2$) was carried out at a temperature of 176.6° F. and at a pH of 4.9. Chlorine dioxide was applied in an amount of 0.17%.

Results are set forth in the Table below.

TABLE 1

| Sample | | 1 | 2 | 3 |
|---|---|---|---|---|
| R10 | % | 86.1 | 86.5 | 86.7 |
| S10 | % | 13.9 | 13.5 | 13.3 |
| R18 | % | 88.1 | 87.8 | 87.7 |
| S18 | % | 11.9 | 12.2 | 12.3 |
| DR | | 2.0 | 1.3 | 1.0 |

TABLE 1-continued

| Sample | | 1 | 2 | 3 |
|---|---|---|---|---|
| Carboxyl | meq/100 g | 3.6 | 3.47 | |
| Aldehydes | meq/100 g | 0.47 | 0.63 | |
| Copper No. | | 0.41 | 0.4 | |
| Calculated Carbonyl* | mmole/ 100 g | 0.57 | 0.55 | |
| CED Viscosity | mPa · s | 8.83 | | |
| Intrinsic Viscosity | [h] dl/g | 5.27 | | |
| Calculated Intrinsic Visc. | [h] dl/g | 5.42 | | |
| Calculated DP*** | $DP_w$ | 1414 | | |
| Glucan | % | 82.2 | 83.4 | |
| Xylan | % | 10.0 | 8.9 | |
| Galactan | % | 0.1 | <0.1 | |
| Mannan | % | 5.9 | 5.8 | |
| Arabinan | % | 0.6 | 0.2 | |
| Calculated Cellulose** | % | 80.2 | 81.5 | |
| Calculated Hemicelllulose | % | 18.5 | 16.8 | |
| Sum Sugars | | 98.8 | 98.4 | |
| DCM extractives | | 0.006 | | <0.1 |
| Iron | ppm | | | |
| Manganese | ppm | | | |

Example 2

Southern pine cellulose was digested in a continuous digester with co-current liquor flow operating at a pulp production rate of 1676 T/D. 16.5% effective alkali was added to the pulp. The white liquor charge was distributed between the impregnator and the digester with one half of the charge being applied in each. A kappa number of 20.9 was reached.

The cellulose fiber was then washed and oxygen delignified in a conventional two-stage oxygen delignification process. Oxygen was applied at a rate of 2% and caustic was applied at a rate of 2.9%. Delignification was carried out at a temperature of 206.1°. The Kappa number as measure at the blend chest was 7.3.

The delignified pulp was bleached in a five-stage bleach plant, with a sequence of D(EOP)D(EP)D. The first D stage ($D_0$) was carried out at a temperature of 14406° F. and at a pH of 2.3. Chlorine dioxide was applied in an amount of 1.9%. Acid was applied in an amount of 36.5 lbs/ton.

The first E stage ($E_1$), was carried out at a temperature of 176.2° F. and at a pH of 11.5. Caustic was applied in an amount of 1.1%. Oxygen was applied in an amount of 10.9 lbs/ton. Hydrogen Peroxide was application in an amount of 8.2 lbs/ton.

The second D stage ($D_1$) was carried out at a temperature of 178.8° F. and at a pH of 3.8. Chlorine dioxide was applied in an amount of 0.8%, Caustic was applied in an amount of 0.07 lbs/ton.

The second E stage ($E_2$) was carried out at a temperature of 178.5° F. and at a pH of 10.8. Caustic was applied in an amount of 0.17%. Hydrogen peroxide was in an amount of 0.07%.

The third D stage ($D_2$) was carried out at a temperature of 184.7° F. and at a pH of 5.0. Chlorine dioxide was applied in an amount of 0.14%.

Results are set forth in the Table below.

TABLE 2

| Sample | | 1 | 2 | 3 | 4 |
|---|---|---|---|---|---|
| R10 | % | 86.8 | 86.5 | 86.5 | 86.8 |
| S10 | % | 13.2 | 13.5 | 13.5 | 13.2 |
| R18 | % | 87.8 | 87.8 | 87.9 | 87.0 |
| S18 | % | 12.2 | 12.2 | 12.1 | 13.0 |
| ΔR | | 1.0 | 1.3 | 1.4 | 0.2 |
| Carboxyl | meq/100 g | 3.25 | 3.36 | 3.35 | |
| Aldehydes | meq/100 g | 0.74 | 2.20 | 0.91 | |
| Copper No. | | 0.37 | 0.35 | 0.37 | |
| Calculated Carbonyl* | mmole/ 100 g | 0.50 | 0.47 | 0.50 | |
| CED Viscosity | mPa · s | 11.4 | 11.4 | 11.4 | 11.4 |
| Intrinsic Viscosity | [η] dl/g | | | | |
| Calculated Intrinsic Visc. | [η] dl/g | 6.24 | 6.24 | 6.24 | 6.24 |
| Calculated DP*** | $DP_w$ | 1706 | 1706 | 1706 | 1706 |
| Glucan | % | 81.4 | 82.0 | 82.9 | 83.1 |
| Xylan | % | 8.0 | 8.4 | 8.6 | 8.5 |
| Galactan | % | 0.2 | 0.2 | 0.2 | 0.4 |
| Mannan | % | 6.6 | 6.5 | 6.6 | 6.4 |
| Arabinan | % | 0.3 | 0.3 | 0.4 | 0.6 |
| Calculated Cellulose** | % | 79.2 | 79.8 | 80.7 | 81.0 |
| Calculated Hemicelllulose | % | 17.1 | 17.4 | 17.8 | 17.6 |
| Sum Sugars | | 96.5 | 97.4 | 98.7 | 99.0 |
| DCM extractives | | 0.012 | | | |
| Iron | ppm | | 1.5 | 1.4 | |
| Manganese | ppm | | 0.179 | 0.195 | |

Example 3

Southern pine cellulose was digested in a continuous digester with co-current liquor flow operating at a pulp production rate of 1715 T/D. 16.9% of effective alkali was added to the pulp. The white liquor charge was distributed between the impregnator and the digester with one half of the charge being applied in each. Digestion was carried out at a temperature of 329.2° F. A kappa number of 19.4 was reached.

The cellulose fiber was then washed and oxygen delignified in a conventional two-stage oxygen delignification process. Oxygen was applied at a rate of 2% and caustic was applied at a rate of 3.2%. Delignification was carried out at a temperature of 209.4°. The Kappa number as measure at the blend chest was 7.5.

The delignified pulp was bleached in a five-stage bleach plant, with a sequence of D(EOP)D(EP)D. The first D stage ($D_0$) was carried out at a temperature of 142.9° F. and at a pH of 2.5. Chlorine dioxide was applied in an amount of 1.3%. Acid was applied in an amount of 24.4 lbs/ton.

The first E stage ($E_1$), was carried out at a temperature of 173.0° F. and at a pH of 11.4. Caustic was applied in an amount of 1.21%. Oxygen was applied in an amount of 10.8 lbs/ton. Hydrogen Peroxide was application in an amount of 7.4 lbs/ton.

The second D stage ($D_1$) was carried out at a temperature of at least about 177.9° F. and at a pH of 3.7. Chlorine dioxide was applied in an amount of 0.7%. Caustic was applied in an amount of 0.34 lbs/ton.

The second E stage ($E_2$) was carried out at a temperature of 175.4° F. and at a pH of 11. Caustic was applied in an amount of 0.4%. Hydrogen peroxide was in an amount of 0.1%.

The third D stage ($D_2$) was carried out at a temperature of 178.2° F. and at a pH of 5.4. Chlorine dioxide was applied in an amount of 0.15%.

Results are set forth in the Table below.

TABLE 3

| Sample | | 1 | 2 | 3 | 4 |
|---|---|---|---|---|---|
| R10 | % | 86.4 | 86.2 | 86.4 | 87.0 |
| S10 | % | 13.6 | 13.8 | 13.6 | 13.0 |
| R18 | % | 86.8 | 87.8 | 88.0 | 87.9 |
| S18 | % | 13.2 | 12.2 | 12.0 | 12.1 |
| ΔR | | 0.4 | 1.6 | 1.6 | 0.9 |
| Carboxyl | meq/100 g | | 3.77 | 3.70 | 3.74 |
| Aldehydes | meq/100 g | | 0.42 | 0.57 | 0.56 |
| Copper No. | | | 0.37 | 0.35 | 0.36 |
| Calculated Carbonyl* | mmole/ 100 g | | 0.50 | 0.47 | 0.48 |
| CED Viscosity | mPa · s | | 10.6 | 9.2 | 9.2 |
| Intrinsic Viscosity | [η] dl/g | | | | |
| Calculated Intrinsic Visc. | [η] dl/g | | 6.01 | 5.55 | 5.55 |
| Calculated DP*** | $DP_w$ | | 1621 | 1460 | 1460 |
| Glucan | % | 80.2 | 85.4 | 84.4 | 84.2 |
| Xylan | % | 8.3 | 8.7 | 8.5 | 8.9 |
| Galactan | % | 0.4 | 0.2 | 0.2 | 0.2 |
| Mannan | % | 6.3 | 5.8 | 5.8 | 5.7 |
| Arabinan | % | 0.6 | 0.4 | 0.3 | 0.3 |
| Calculated Cellulose** | % | 78.1 | 83.5 | 82.5 | 82.3 |
| Calculated Hemicelllulose | % | 17.7 | 18.7 | 19.7 | 20.7 |
| Sum Sugars | | 95.8 | 100.5 | 99.3 | 99.3 |
| DCM extractives | | | | | |
| Iron | ppm | | 0.84 | 0.97 | 0.95 |
| Manganese | ppm | | 0.2 | 0.24 | 0.45 |

Example 4

1680 tons of Southern pine cellulose was digested in a continuous digester with co-current liquor flow operating at a pulp production rate of 1680 T/D. 18.0% effective alkali was added to the pulp. The white liquor charge was distributed between the impregnator and the digester with one half of the charge being applied in each. A kappa number of 17 was reached.

The cellulose fiber was then washed and oxygen delignified in a conventional two-stage oxygen delignification process. Oxygen was applied at a rate of 2% and caustic was applied at a rate of 3.15%. Delignification was carried out at a temperature of 210°. The Kappa number as measure at the blend chest was 6.5.

The delignified pulp was bleached in a five-stage bleach plant, with a sequence of D(EOP)D(EP)D. The first D stage ($D_0$) was carried out at a temperature of 140° F. Chlorine dioxide was applied in an amount of 1.3%. Acid was applied in an amount of 15 lbs/ton.

The first E stage ($E_1$), was carried out at a temperature of 180° F. Caustic was applied in an amount of 1.2%. Oxygen was applied in an amount of 10.5 lbs/ton. Hydrogen Peroxide was application in an amount of 8.3 lbs/ton.

The second D stage (D1) was carried out at a temperature of at least about 180° F. Chlorine dioxide was applied in an amount of 0.7%. Caustic was not applied.

The second E stage ($E_2$) was carried out at a temperature of 172° F. Caustic was applied in an amount of 0.4%. Hydrogen peroxide was in an amount of 0.08%.

The third D stage ($D_2$) was carried out at a temperature of 180° F. Chlorine dioxide was applied in an amount of 0.18%.

Results are set forth in the Table below.

TABLE 4

| Sample | | 1 | 2 | 3 |
|---|---|---|---|---|
| R10 | % | 86 | 86.2 | 86.2 |
| S10 | % | 14 | 13.8 | 13.8 |
| R18 | % | 87.8 | 87.8 | 87.8 |
| S18 | % | 12.2 | 12.2 | 12.2 |
| ΔR | | 1.8 | 1.6 | 1.6 |
| Carboxyl | meq/100 g | 3.06 | 2.67 | 3.27 |
| Aldehydes | meq/100 g | 1.03 | 0.99 | 0.06 |
| Copper No. | | 0.28 | 0.34 | 0.27 |
| Calculated Carbonyl* | mmole/100 g | 0.35 | 0.45 | 0.33 |
| CED Viscosity | mPa · s | 8 | 8.9 | 8.9 |
| Intrinsic Viscosity | [η] dl/g | | | |
| Calculated Intrinsic Visc. | [η] dl/g | 5.10 | 5.44 | 5.44 |
| Calculated DP*** | $DP_w$ | 1305 | 1423 | 1423 |
| Glucan | % | 86.2 | 86.2 | 86.4 |
| Xylan | % | 8.5 | 7.5 | 8.7 |
| Galactan | % | 0.2 | 0.3 | 0.2 |
| Mannan | % | 5.0 | 4.7 | 5.3 |
| Arabinan | % | 0.4 | 0.4 | 0.3 |
| Calculated Cellulose** | % | 82.3 | 82.3 | 82.3 |
| Calculated Hemicelllulose | % | 20.7 | 20.7 | 20.7 |
| Sum Sugars | | 100.2 | 99.0 | 101.0 |
| DCM extractives | | | | |
| Iron | ppm | 1.66 | 1.76 | 1.64 |
| Manganese | ppm | 0.27 | 0.34 | 0.34 |

Example 5

Characteristics of the fiber samples produced according to the Examples above, including whiteness and brightness were measured. The results are reported below.

Brightness Measurements

| Sheets | | | | | |
|---|---|---|---|---|---|
| Illuminant/Observer D65/10 | | | Illuminant/Observer C/2 | | |
| Example 2 | Avg. | σ | Example 2 | Avg. | σ |
| L* | 98.6 | 0.04 | L* | 98.4 | 0.08 |
| a* | −0.72 | 0.02 | a* | −0.9 | 0.02 |
| b* | 1.9 | 0.08 | b* | 1.75 | 0.06 |
| Brightness | 94.01 | 0.23 | Brightness | 93.59 | 0.24 |
| Whiteness Index | 85.27 | 0.71 | Whiteness Index | 85.41 | 0.55 |

| TAPPI Brightness Pads | | | | | |
|---|---|---|---|---|---|
| Illuminant/Observer D65/10 | | | Illuminant/Observer C/2 | | |
| Example 2 | Avg. | σ | Example 2 | Avg. | σ |
| L* | 98.49 | 0.09 | L* | 98.08 | 0.15 |
| a* | −0.74 | 0.02 | a* | −0.86 | 0.01 |
| b* | 1.89 | 0.04 | b* | 1.74 | 0.07 |
| Brightness | 93.78 | 0.23 | Brightness | 93.87 | 0.19 |
| Whiteness Index | 85.01 | 0.50 | Whiteness Index | 84.84 | 0.17 |

| Sheets | | | | | |
|---|---|---|---|---|---|
| Illuminant/Observer D65/10 | | | Illuminant/Observer C/2 | | |
| Example 3 | Avg. | σ | Example 3 | Avg. | σ |
| L* | 98.25 | 0.06 | L* | 98.29 | 0.00 |
| a* | −0.54 | 0.02 | a* | −0.72 | 0.02 |
| b* | 1.63 | 0.08 | b* | 1.65 | 0.07 |
| Brightness | 93.54 | 0.17 | Brightness | 93.39 | 0.13 |
| Whiteness Index | 86.33 | 0.54 | Whiteness Index | 86.28 | 0.38 |
| Dryer lab measured brightness | 92.2 | | | | |

| | | Fiber of Example 3 | | | |
|---|---|---|---|---|---|
| Pulp Sheet Characteristics | | Sample 1 | Sample 2 | Sample 3 | Average |
| ISO Surface Brightness | % | 92.60 | 92.73 | 92.24 | 92.52 |
| L | | 97.80 | 97.83 | 97.78 | 97.80 |
| a | | −0.81 | −0.85 | −0.91 | −0.86 |
| b | | 2.38 | 2.31 | 2.61 | 2.43 |
| Fluorescence | | 0.01 | 0.06 | 0.05 | 0.04 |
| Calculated CIE Whiteness | | 85.30 | 85.70 | 84.30 | 85.10 |

| | | Fiber of Example 4. | | | |
|---|---|---|---|---|---|
| | | Sample 1 | Sample 2 | Sample 3 | Average |
| Pulp Sheet Characteristics | | | | | |
| ISO Surface Brightness | % | 92.57 | 92.68 | 92.50 | 92.58 |
| L | | 97.73 | 97.69 | 97.69 | 97.70 |
| a | | −0.74 | −0.63 | −0.70 | −0.69 |
| b | | 2.25 | 2.12 | 2.26 | 2.21 |
| Fluorescence | | 0.02 | 0.07 | 0.05 | 0.05 |
| DCME | % | 0.000 | 0.000 | 0.000 | 0.000 |
| Acid Insoluble Ash | | | | | |
| Total Ash | % | 0.083 | 0.083 | 0.079 | 0.082 |
| AIA | ppm | 135 | 75 | 35 | 82 |
| Sand Content | ppm | 0 | 0 | 0 | 0 |

Example 6

The solubility of fiber produced by a method consistent with Examples 1-4 was tested for S10, S18, R10 and R18 values. The results are set forth below.

| Sample | Solubility of Pulp (%)(average) $S_{10}$ | $S_{18}$ | % Retained $R_{10}$ | $R_{18}$ |
|---|---|---|---|---|
| Sample A, after 5-stage bleaching | 12.8 | 11.9 | 87.2 | 88.1 |

| Sample | Solubility of Pulp (%)(average) $S_{10}$ | $S_{18}$ | % Retained $R_{10}$ | $R_{18}$ |
|---|---|---|---|---|
| Sample B, after 5-stage bleaching | 13.8 | 13.3 | 86.2 | 86.7 |

Example 7

The carbohydrate content of fiber produced by the method of Example 5 were measured. The first two tables below report data based upon an average of two determinations. The first table is the fiber of the present invention and the second table is the control. The second two tables are values normalized to 100%.

Inventive Sample

| | Carbohydrates | | | | | |
|---|---|---|---|---|---|---|
| | Arabinan % | Galactan % | Glucan % | Xylan % | Man-nan % | Carbo-hydrates % |
| Brownstock | 0.48 | 0.34 | 81.90 | 9.13 | 6.46 | 98.31 |
| Decker (O2 system) | 0.43 | 0.27 | 81.03 | 8.67 | 6.19 | 96.59 |
| E1 | 0.42 | 0.23 | 84.47 | 8.78 | 6.30 | 100.20 |
| D1 | 0.45 | 0.26 | 86.17 | 9.18 | 6.52 | 102.58 |
| E2 | 0.37 | 0.24 | 86.44 | 8.86 | 6.46 | 102.37 |
| D2 | 0.45 | 0.24 | 84.97 | 8.92 | 6.45 | 101.04 |

Control

| | Carbohydrates | | | | | |
|---|---|---|---|---|---|---|
| | Arabinan % | Galactan % | Glucan % | Xylan % | Man-nan % | Carbo-hydrates % |
| Brownstock | 0.64 | 0.42 | 81.24 | 9.97 | 6.74 | 99.01 |
| Decker (O2 system) | 0.62 | 0.30 | 82.86 | 9.78 | 6.62 | 100.18 |
| E1 | 0.60 | 0.29 | 83.34 | 9.72 | 6.62 | 100.58 |
| D1 | 0.55 | 0.26 | 83.46 | 9.66 | 6.56 | 100.49 |
| E2 | 0.47 | 0.26 | 83.20 | 9.52 | 6.49 | 99.94 |
| D2 | 0.55 | 0.27 | 84.64 | 9.75 | 6.66 | 101.88 |

Normalized

| | Carbohydrates | | | | | |
|---|---|---|---|---|---|---|
| | Arabinan % | Galactan % | Glucan % | Xylan % | Man-nan % | Carbo-hydrates % |
| Brownstock | 0.48 | 0.35 | 83.31 | 9.28 | 6.57 | 100.00 |
| Decker (O2 system) | 0.45 | 0.28 | 83.89 | 8.97 | 6.41 | 100.00 |

-continued

Normalized

| | Carbohydrates | | | | | |
|---|---|---|---|---|---|---|
| | Arabinan % | Galactan % | Glucan % | Xylan % | Man-nan % | Carbo-hydrates % |
| E1 | 0.42 | 0.23 | 84.31 | 8.76 | 6.28 | 100.00 |
| D1 | 0.44 | 0.25 | 84.01 | 8.95 | 6.35 | 100.00 |
| E2 | 0.37 | 0.24 | 84.44 | 8.65 | 6.31 | 100.00 |
| D2 | 0.45 | 0.24 | 84.10 | 8.83 | 6.38 | 100.00 |

Control

| | Carbohydrates | | | | | |
|---|---|---|---|---|---|---|
| | Arabinan % | Galactan % | Glucan % | Xylan % | Man-nan % | Carbo-hydrates % |
| Brownstock | 0.64 | 0.42 | 82.05 | 10.07 | 6.81 | 100.00 |
| Decker (O2 system) | 0.62 | 0.30 | 82.71 | 9.76 | 8.60 | 100.00 |
| E1 | 0.59 | 0.29 | 82.86 | 9.67 | 6.58 | 100.00 |
| D1 | 0.55 | 0.26 | 83.05 | 9.61 | 6.52 | 100.00 |
| E2 | 0.47 | 0.26 | 83.25 | 9.52 | 6.50 | 100.00 |
| D2 | 0.54 | 0.26 | 83.09 | 9.57 | 6.54 | 100.00 |

Example 8

Southern pine chips were cooked in a two vessel continuous digester with Lo-Solids® downflow cooking. The white liquor application was 8.42% as effective alkali (EA) in the impregnation vessel and 8.59% in the quench circulation. The quench temperature was 166° C. The kappa no. after digesting was 20.4. The brownstock pulp was further delignified in a two stage oxygen delignification system with 2.98% sodium hydroxide (NaOH) and 2.31% oxygen ($O_2$) applied. The temperature was 98° C. The first reactor pressure was 758 kPa and the second reactor was 372 kPa. The kappa no. was 6.95.

The oxygen delignified pulp was bleached in a 5 stage bleach plant. The first chlorine dioxide stage (D0) was carried out with 0.90% chlorine dioxide ($ClO_2$) applied at a temperature of 61° C. and a pH of 2.4.

The second or oxidative alkaline extraction stage (EOP) was carried out at a temperature of 76° C. NaOH was applied at 0.98%, hydrogen peroxide ($H_2O_2$) at 0.44%, and oxygen ($O_2$) at 0.54%. The kappa no. after oxygen delignification was 2.1.

The third or chlorine dioxide stage (D1) was carried out at a temperature of 74° C. and a pH of 3.3. $ClO_2$ was applied at 0.61% and NaOH at 0.02%. The 0.5% Capillary CED viscosity was 10.0 mPa·s.

The fourth stage was altered to produce a low degree of polymerization pulp. Ferrous sulfate heptahydrate ($FeSO_4.7H_2O$) was added as a 2.5 lb/gal aqueous solution at a rate to provide 75 ppm $Fe^{+2}$ on pulp at the repulper of the D1 washer. The pH of the stage was 3.3 and the temperature was 80° C. $H_2O_2$ was applied at 0.26% on pulp at the suction of the stage feed pump.

The fifth or final chlorine dioxide stage (D2) was carried out at a temperature of 80° C., and a pH of 3.9 with 0.16% $ClO_2$ applied. The viscosity was 5.0 mPa·s and the brightness was 90.0% ISO.

The iron content was 10.3 ppm, the measured extractives were 0.018%, and the ash content was 0.1%. Additional results are set forth in the Table below.

Example 9

Southern pine chips were cooked in a two vessel continuous digester with Lo-Solids® downflow cooking. The white liquor application was 8.12% as effective alkali (EA) in the impregnation vessel and 8.18% in the quench circulation. The quench temperature was 167° C. The kappa no. after digesting was 20.3. The brownstock pulp was further delignified in a two stage oxygen delignification system with 3.14% NaOH and 1.74% $O_2$ applied. The temperature was 98° C. The first reactor pressure was 779 kPa and the second reactor was 372 kPa. The kappa no. after oxygen delignification was 7.74.

The oxygen delignified pulp was bleached in a 5 stage bleach plant. The first chlorine dioxide stage (D0) was carried out with 1.03% $ClO_2$ applied at a temperature of 68° C. and a pH of 2.4.

The second or oxidative alkaline extraction stage (EOP) was carried out at a temperature of 87° C. NaOH was applied at 0.77%, $H_2O_2$ at 0.34%, and $O_2$ at 0.45%. The kappa no. after the stage was 2.2.

The third or chlorine dioxide stage (D1) was carried out at a temperature of 76° C. and a pH of 3.0. $ClO_2$ was applied at 0.71% and NaOH at 0.11%. The 0.5% Capillary CED viscosity was 10.3 mPa·s.

The fourth stage was altered to produce a low degree of polymerization pulp. Ferrous sulfate heptahydrate ($FeSO_4.7H_2O$) was added as a 2.5 lb/gal aqueous solution at a rate to provide 75 ppm $Fe^{+2}$ on pulp at the repulper of the D1 washer. The pH of the stage was 3.3 and the temperature was 75° C. $H_2O_2$ was applied at 0.24% on pulp at the suction of the stage feed pump.

The fifth or final chlorine dioxide stage (D2) was carried out at a temperature of 75° C., and a pH of 3.75 with 0.14% $ClO_2$ applied. The viscosity was 5.0 mPa·s and the brightness was 89.7% ISO.

The iron content was 15 ppm. Additional results are set forth in the Table below.

Example 10

Southern pine chips were cooked in a two vessel continuous digester with Lo-Solids® downflow cooking. The white liquor application was 7.49% as effective alkali (EA) in the impregnation vessel and 7.55% in the quench circulation. The quench temperature was 166° C. The kappa no. after digesting was 19.0, The brownstock pulp was further delignified in a two stage oxygen delignification system with 3.16% NaOH and 1.94% $O_2$ applied. The temperature was 97° C. The first reactor pressure was 758 kPa and the second reactor was 337 kPa. The kappa no, after oxygen delignification was 6.5.

The oxygen delignified pulp was bleached in a 5 stage bleach plant. The first chlorine dioxide stage (D0) was carried out with 0.88% $ClO_2$ applied at a temperature of 67° C. and a pH of 2.6.

The second or oxidative alkaline extraction stage (EOP) was carried out at a temperature of 83° C. NaOH was applied at 0.74%, $H_2O_2$ at 0.54%, and $O_2$ at 0.45%. The kappa no, after the stage was 1.8.

The third or chlorine dioxide stage (D1) was carried out at a temperature of 78° C. and a pH of 2.9. $ClO_2$ was applied at 0.72% and NaOH at 0.04%. The 0.5% Capillary CED viscosity was 10.9 mPa·s.

The fourth stage was altered to produce a low degree of polymerization pulp. Ferrous sulfate heptahydrate ($FeSO_4.7H_2O$) was added as a 2.5 lb/gal aqueous solution at a rate to provide 75 ppm $Fe^{+2}$ on pulp at the repulper of the D1 washer. The pH of the stage was 2.9 and the temperature was 82° C. $H_2O_2$ was applied at 0.30% on pulp at the suction of the stage feed pump.

The fifth or final chlorine dioxide stage (D2) was carried out at a temperature of 77° C., and a pH of 3.47 with 0.14% $ClO_2$ applied. The viscosity was 5.1 mPa·s and the brightness was 89.4% ISO.

The iron content was 10.2 ppm. Additional results are set forth in the Table below.

Example 11

Comparative Example

Southern pine chips were cooked in a two vessel continuous digester with Lo-Solids® downflow cooking. The white liquor application was 8.32% as effective alkali (EA) in the impregnation vessel and 8.46% in the quench circulation. The quench temperature was 162° C. The kappa no. after digesting was 27.8. The brownstock pulp was further delignified in a two stage oxygen delignification system with 2.44% NaOH and 1.91% $O_2$ applied. The temperature was 97° C. The first reactor pressure was 779 kPa and the second reactor was 386 kPa. The kappa no. after oxygen delignification was 10.3.

The oxygen delignified pulp was bleached in a 5 stage bleach plant. The first chlorine dioxide stage (D0) was carried out with 0.94% $ClO_2$ applied at a temperature of 66° C. and a pH of 2.4.

The second or oxidative alkaline extraction stage (EOP) was carried out at a temperature of 83° C., NaOH was applied at 0.89%, $H_2O_2$ at 0.33%, and $O_2$ at 0.20%. The kappa no, after the stage was 2.9.

The third or chlorine dioxide stage (D1) was carried out at a temperature of 77° C. and a pH of 2.9. $ClO_2$ was applied at 0.76% and NaOH at 0.13%. The 0.5% Capillary CED viscosity was 14.0 mPa·s.

The fourth stage was altered to produce a low degree of polymerization pulp. Ferrous sulfate heptahydrate ($FeSO_4.7H_2O$) was added as a 2.5 lb/gal aqueous solution at a rate to provide 150 ppm $Fe^{+2}$ on pulp at the repulper of the D1 washer. The pH of the stage was 2.6 and the temperature was 82° C. $H_2O_2$ was applied at 1.6% on pulp at the suction of the stage feed pump.

The fifth or final chlorine dioxide stage (D2) was carried out at a temperature of 85° C., and a pH of 3.35 with 0.13% $ClO_2$ applied. The viscosity was 3.6 mPa·s and the brightness was 88.7% ISO.

Each of the bleached pulps produced in the above examples were made into a pulp board on a Fourdrinier type pulp dryer with an airborne Flat dryer section. Samples of each pulp were collected and analyzed for chemical composition and fiber properties. The results are shown in Table 5.

The results show that the pulps produced with a low viscosity or $DP_w$ by a combination of increased delignification and an acid catalyzed peroxide stage (Examples 8-10) have lower carbonyl contents than the comparative example with standard delignification and an increased acid catalyzed peroxide stage. The pulp of the present invention exhibits significantly less yellowing when subjected to a caustic-based process such as the manufacture of cellulose ethers and viscose.

Results are set forth in the Table below.

TABLE 5

| Property | units | Example 8 | Example 9 | Example 10 | Comparative example 11 |
|---|---|---|---|---|---|
| R10 | % | 81.5 | 82.2 | 80.7 | 71.6 |
| S10 | % | 18.5 | 17.8 | 19.3 | 28.4 |
| R18 | % | 85.4 | 85.9 | 84.6 | 78.6 |
| S18 | % | 14.6 | 14.1 | 15.4 | 21.4 |
| ΔR | | 3.9 | 3.7 | 3.9 | 7.0 |
| Carboxyl | meq/100 g | 3.14 | 3.51 | 3.78 | 3.98 |
| Aldehydes | meq/100 g | 1.80 | 2.09 | 1.93 | 5.79 |
| Copper No. | | 1.36 | 1.1 | 1.5 | 3.81 |
| Calculated Carbonyl* | mmole/100 g | 2.15 | 1.72 | 2.38 | 6.23 |
| CED Viscosity | mPa · s | 5.0 | 5.1 | 5.0 | 3.6 |
| Intrinsic Viscosity | [h] dl/g | 3.58 | 3.64 | 3.58 | 2.52 |
| Calculated DP*** | $DP_w$ | 819 | 839 | 819 | 511 |
| Glucan | % | 83.5 | 84.3 | 84.7 | 83.3 |
| Xylan | % | 7.6 | 7.4 | 6.6 | 7.6 |
| Galactan | % | <0.1 | 0.2 | 0.2 | 0.1 |
| Mannan | % | 6.3 | 5.0 | 4.1 | 6.3 |
| Arabinan | % | 0.4 | 0.2 | 0.3 | 0.2 |
| Calculated Cellulose** | % | 81.4 | 82.6 | 83.3 | 81.2 |
| Calculated Hemicelllulose | % | 16.5 | 14.5 | 12.6 | 16.3 |

Example 12

Test for Yellowing

Dried pulp sheets from Example 9 and the comparative example were cut into 3"×3" squares. The brightness and color values as CIE L*, a*, b* coordinates were determined on a Hunterlab MiniScan™ XE instrument, Each of the squares was placed separately in a tray and 30 mls of 18% NaOH was added to saturate the sheet. The square was removed from the tray and NaOH solution after 5 minutes. The brightness and color values were measured on the saturated sheet.

The L*, a*, b* system describes a color space as:

$L^*=0$ (black)−100 (white)

$a^*=-a$ (green)−$+a$ (red)

$b^*=-b$ (blue)−$+b$ (yellow)

The results are shown in Table 6. The pulp of example 9 exhibits significantly less yellowing as seen in the smaller b* value for the saturated sample and in the smaller increase of the b* value upon saturation.

TABLE 6

Properties of Initial and NaOH Saturated Pulps

| | initial | NaOH saturated sample | Δ |
|---|---|---|---|
| **Comparative example** | | | |
| L* | 95.42 | 67.7 | 27.72 |
| a* | −0.44 | 1.17 | −1.61 |
| b* | 5.55 | 44.71 | −39.16 |
| Brightness | 81.76 | 13.4 | 68.36 |
| **Comparative example** | | | |
| L* | 96.5 | 71.86 | 24.65 |
| a* | −0.88 | −2.26 | 1.38 |
| b* | 3.39 | 38.72 | −35.34 |
| Brightness | 87.03 | 19.50 | 67.54 |
| **Example 9** | | | |
| L* | 95.84 | 74.52 | 21.32 |
| a* | −0.35 | −2.83 | 2.48 |
| b* | 4.23 | 21.62 | −17.39 |
| Brightness | 84.32 | 31.88 | 52.44 |
| **Example 10** | | | |
| L* | 96.31 | 73.8 | 22.51 |
| a* | −0.81 | −2.78 | 1.97 |
| b* | 3.67 | 22.36 | −18.69 |
| Brightness | 86.21 | 29.39 | 56.82 |
| **Example 13** | | | |
| **STD. FLUFF** | | | |
| L* | 96.82 | 75.31 | 21.51 |
| a* | −1.04 | −1.99 | 0.95 |
| b* | 3.5 | 10.41 | −6.9 |
| Brightness | 87.69 | 40.67 | 47.02 |

Example 13

Standard Fluff Pulp

Southern pine chips were cooked in a two vessel continuous digester with Lo-Solids® downflow cooking. The white liquor application was 8.32% as effective alkali (EA) in the impregnation vessel and 8.46% in the quench circulation. The quench temperature was 162° C. The kappa no, after digesting was 27.8. The brownstock pulp was further delignified in a two stage oxygen delignification system with 2.44% NaOH and 1.91% $O_2$ applied. The temperature was 97° C. The first reactor pressure was 779 kPa and the second reactor was 386 kPa. The kappa no. after oxygen delignification was 10.3.

The oxygen delignified pulp was bleached in a 5 stage bleach plant. The first chlorine dioxide stage (D0) was carried out with 0.94% $ClO_2$ applied at a temperature of 66° C. and a pH of 2.4.

The second or oxidative alkaline extraction stage (EOP) was carried out at a temperature of 83° C. NaOH was applied at 0.89%, $H_2O_2$ at 0.33%, and $O_2$ at 0.20%. The kappa no. after the stage was 2.9.

The third or chlorine dioxide stage (D1) was carried out at a temperature of 77° C. and a pH of 2.9, $ClO_2$ was applied at 0.76% and NaOH at 0.13%. The 0.5% Capillary CED viscosity was 14.0 mPa·s.

The fourth stage (EP) was a peroxide reinforced alkaline extraction stage. The pH of the stage was 10.0 and the temperature was 82° C. NaOH was applied at 0.29% on pulp. $H_2O_2$ was applied at 0.10% on pulp at the suction of the stage feed pump.

The fifth or final chlorine dioxide stage (D2) was carried out at a temperature of 85° C., and a pH of 3.35 with 0.13% $ClO_2$ applied. The viscosity was 13.2 mPa·s and the brightness was 90.9% ISO.

Example 14

Surfactant Treated Pulp

Fiber made according to Examples 1-4 was treated with surfactant DB999 from Cellulose Solutions to form a surfactant treated pulp. DB999 is proprietary to the manufacturer, Cellulose Solutions, however, it is known to be a vegetable based fatty acid quaternary compound. The surfactant was added to the pulp just prior to the headbox of the pulp machine in amounts ranging from 0.25 lbs/ton to 1.5 lbs/ton. The pulp was subsequently formed into bales.

| | #/ton | Wt | | | | Mullen kPa | | |
|---|---|---|---|---|---|---|---|---|
| Lot | DB999 | (MT) | % AD | Bright. | Visc. | Avg | sd | % R18 |
| 6 | 1.5 | 71.1 | 98.95 | 92.3 | 9.23 | 975 | 95 | 89.15 |
| 5 | 1 | 28.3 | 98.77 | 92.5 | 8.85 | 1034 | 96 | |
| 4 | 0.75 | 24.3 | 98.82 | 92.5 | 8.85 | 1028 | 96 | |
| 3 | 0.5 | 40.5 | 160 | 98.76 | 92.5 | 8.69 | 1133 | 120 |
| 2 | 0.25 | 60.9 | 240 | 98.96 | 92.5 | 8.69 | 1114 | 105 |
| 1 | 0 | | | | | | 1120 | 103 |

Figure 3:
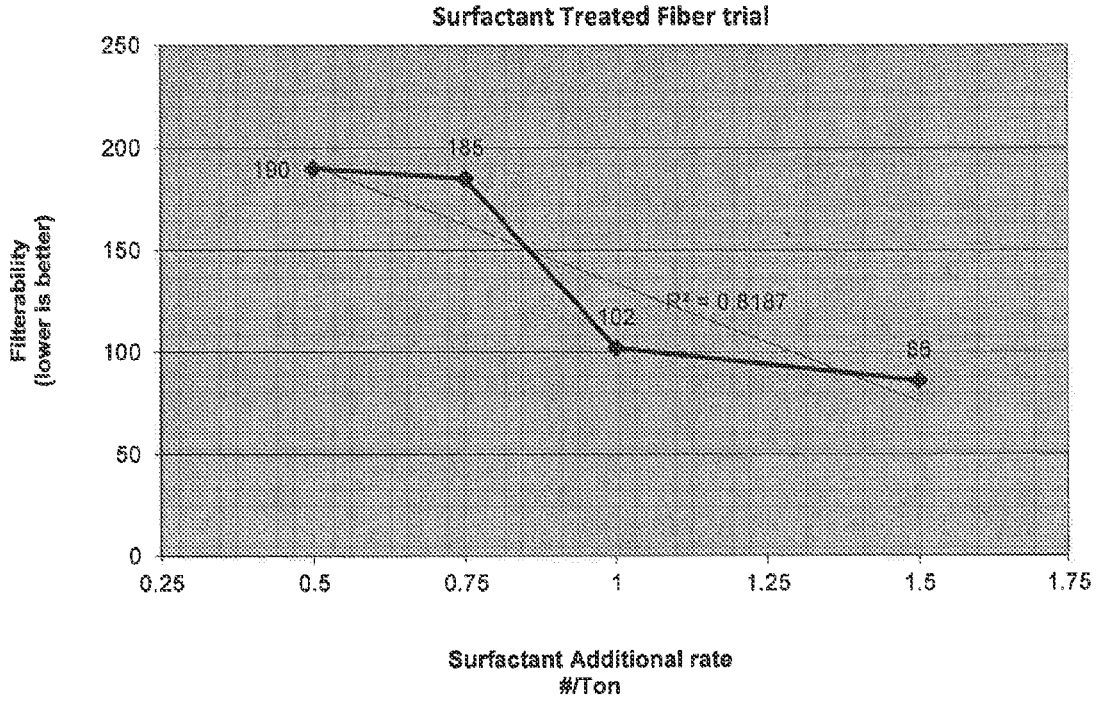
FIG. 3 is a graph of filterability as a function of the amount of surfactant added to the pulp.

The surfactant treated fibers were used in the process for preparing viscose. Process conditions and the properties of the fiber are set forth in FIGS. 3, 4 and 5, The PFI results are set forth below.

| | | | |
|---|---|---|---|
| Lot 5 - 1.00 | | | |
| Specific Absorption | sec/g | 0.79 | |
| Specific Capacity | g/g | 9.11 | |
| Dry Bulk | cc/g | 18.7 | |
| Wet Bulk | cc/g | 6.22 | |
| Lot 4 - 0.75 | | | |
| Specific Absorption | sec/g | 0.65 | |
| Specific Capacity | g/g | 9.19 | |
| Dry Bulk | cc/g | 17.9 | |
| Wet Bulk | cc/g | 6.35 | |
| Lot 2 - 0.25 | | | |
| Specific Absorption | sec/g | 0.71 | |
| Specific Capacity | g/g | 9.26 | |
| Dry Bulk | cc/g | 18.2 | |
| Wet Bulk | cc/g | 6.55 | |
| | | | STDEV |
| Lot 6 - 1.50 | | | |
| Specific Absorption | sec/g | 0.89 | 0.096 |
| Specific Capacity | g/g | 9.1 | 0.079 |
| Dry Bulk | cc/g | 18.1 | |
| Wet Bulk | cc/g | 6.1 | |
| Lot 1 - Control 3.00 | | | |
| Specific Absorption | sec/g | 0.67 | 0.021 |
| Specific Capacity | g/g | 9.12 | 0.128 |
| Dry Bulk | cc/g | 17.9 | |
| Wet Bulk | cc/g | 6.22 | |
| Lot 3 - 0.50 | | | |
| Specific Absorption | sec/g | 0.69 | 0.033 |
| Specific Capacity | g/g | 9.19 | 0.061 |
| Dry Bulk | cc/g | 18.0 | |
| Wet Bulk | cc/g | 6.42 | |

A number of embodiments have been described. Nevertheless, it will be understood that various modifications may be made without departing from the spirit and scope of the disclosure. Accordingly, other embodiments are within the scope of the following claims.

We claim:

1. A method for making a surfactant treated kraft pulp comprising:

digesting and oxygen delignifying a softwood cellulose pulp to a kappa number of less than 8;

bleaching the cellulosic kraft pulp using a multi-stage bleaching process; and treating the pulp with at least one cationic surface active agent that is not substantive to the fiber.

2. The method of claim 1, wherein the softwood fiber is southern pine fiber.

3. The method of claim 1, wherein the digestion is carried out in two stages including an impregnator and a co-current down-flow digester.

4. The method of claim 1, wherein the surfactant treated pulp has at least a 10% filterability improvement over an identical untreated fiber.

5. The method of claim 1, wherein the surfactant treated pulp has at least a 20% filterability improvement over an identical untreated fiber.

6. The method of claim 1, wherein the surfactant treated pulp has an increase in specific absorption rate of less than 30% over an identical untreated fiber.

7. The method of claim 1, wherein the softwood cellulose pulp is digested to a kappa number of from about 17 to about 21.

8. A method for making a surfactant treated kraft pulp comprising:

digesting and oxygen delignifying a softwood cellulose pulp to a kappa number of less than 8;

bleaching the cellulosic kraft pulp using a multi-stage bleaching process;

oxidizing the kraft pulp during at least one stage of the multi-stage bleaching process with a peroxide and a catalyst under acidic condition, wherein the multi-stage bleaching process comprises at least one bleaching stage following the oxidation stage; and treating the pulp with at least one cationic surface active agent that is not substantive to the fiber.

9. The method of claim 8, wherein the softwood fiber is southern pine fiber.

10. The method of claim 8, wherein the catalyst is chosen from at least one of copper and iron.

11. The method of claim 8, wherein the catalyst is present in an amount of from about 25 ppm to about 100 ppm.

12. The method of claim 8, wherein the peroxide is hydrogen peroxide.

13. The method of claim 12, wherein the hydrogen peroxide is present in an amount of from 0.1% to about 0.5%.

14. The method of claim 8, wherein the pH of the oxidation stage ranges from about 2 to about 6.

15. The method of claim 14, wherein the digestion is carried out in two stages including an impregnator and a co-current down-flow digester.

16. The method of claim 8, wherein the surfactant treated pulp has at least a 10% filterability improvement over an identical untreated fiber.

17. The method of claim 8, wherein the surfactant treated pulp has at least a 20% filterability improvement over an identical untreated fiber.

18. The method of claim 8, wherein the surfactant treated pulp has an increase in specific absorption rate of less than 30% over an identical untreated fiber.

19. The method of claim 8, wherein the softwood cellulose pulp is digested to a kappa number of from about 17 to about 21.

20. A softwood kraft fiber having improved dispersibility and anti-yellowing characteristics made by a method which does not include a pre-hydrolysis step comprising:

digesting and oxygen delignifying a softwood cellulose pulp to a kappa number of less than 8;

bleaching the cellulosic kraft pulp using a multi-stage bleaching process;

oxidizing the kraft pulp during at least one stage of the multi-stage bleaching process with a peroxide and a catalyst under acidic condition, wherein the multi-stage bleaching process comprises at least one bleaching stage following the oxidation stage; and treating the pulp with at least one cationic surface active agent that is not substantive to the fiber.

21. The fiber of claim 20, wherein the fiber has a b* color value in the NaOH saturated state of less than 30.

22. The fiber of claim 20, wherein the fiber has a Δb* color value of less than about 25.

23. The fiber of claim 22, wherein the catalyst is chosen from iron or copper in an amount of from 25 ppm to 100 ppm and the peroxide is hydrogen peroxide in an amount of from 0.1% to about 0.5% on pulp.

24. The fiber of claim 20, wherein the surfactant treated fiber has at least a 10% filterability improvement over an identical untreated fiber.

25. The fiber of claim 20, wherein the surfactant treated fiber has at least a 20% filterability improvement over an identical untreated fiber.

26. The fiber of claim 20, wherein the surfactant treated fiber has an increase in specific absorption rate of less than 30% over an identical untreated fiber.

27. The fiber of claim 20, wherein the softwood cellulose pulp is digested to a kappa number of from about 17 to about 21 prior to oxygen delignification.

28. The fiber of claim 20, wherein the at least one cationic surface active agent comprises a fatty acid quaternary ammonium salt.

29. A softwood kraft pulp comprising a softwood kraft fiber having an ISO brightness of at least about 92%, a CIE whiteness of at least about 85, and an R18 value of from about 84% to about 91% and at least one cationic surface active agent that is not substantive to the fiber.

30. The kraft pulp of claim 29, wherein the softwood fiber is southern pine fiber.

31. The kraft pulp of claim 29, wherein the CIE whiteness is at least about 86.

32. The kraft pulp of claim 29, wherein the R18 value is about 88%.

33. The pulp of claim 29, wherein the surfactant treated pulp has at least a 10% filterability improvement over an identical untreated fiber.

34. The pulp of claim 29, wherein the surfactant treated pulp has at least a 20% filterability improvement over an identical untreated fiber.

35. The pulp of claim 29, wherein the surfactant treated pulp has an increase in specific absorption rate of less than 30% over an identical untreated fiber.

36. The kraft pulp of claim 29, wherein the at least one cationic surface active agent comprises a fatty acid quaternary ammonium salt.

37. A softwood kraft fiber having an R18 value of from about 84% to about 91% A made by the method which does not include a pre-hydrolysis step comprising:

digesting and oxygen delignifying a softwood cellulose pulp to a kappa number of less than 8;

bleaching the cellulose fiber in a multi-stage bleaching sequence to an ISO brightness of 92; and treating the pulp with at least one cationic surface active agent that is not substantive to the fiber.

38. The fiber of claim 37, wherein the CIE whiteness of the fiber after bleaching is at least about 85.

39. The fiber of claim 37, wherein the surfactant treated pulp has an increase in specific absorption rate of less than 30% over an identical untreated fiber, and has at least a 10% filterability improvement over an identical untreated fiber.

40. The fiber of claim 37, wherein the softwood cellulose pulp is digested to a kappa number of from about 17 to about 21 prior to oxygen delignification.

41. The fiber of claim 37, wherein the fiber comprises southern pine.

42. The fiber of claim 37, wherein the fiber is incorporated into a viscose solution.

43. The fiber of claim 42, wherein the fiber comprises up to 35% of the total cellulosic material in the viscose solution.

44. The fiber of claim 42, wherein the fiber comprises from about 10% to about 35% of the total cellulosic material in the viscose solution.

45. The fiber of claim 37, wherein the at least one cationic surface active agent comprises a fatty acid quaternary ammonium salt.

46. A kraft pulp comprising:

a modified bleached softwood kraft fiber exhibiting a total carbonyl content of less than about 2.5 mmoles/100 g and a CED viscosity of less than about 5 mPa·s, and at least one cationic surface active agent that is not substantive to the fiber.

47. The fiber of claim 46, wherein the surfactant treated pulp has an increase in specific absorption rate of less than 30% over an identical untreated fiber, and has at least a 10% filterability improvement over an identical untreated fiber.

* * * * *